US010172490B2

(12) United States Patent
Goldman et al.

(10) Patent No.: US 10,172,490 B2
(45) Date of Patent: Jan. 8, 2019

(54) COLLAPSIBLE HOOK HANGER

(71) Applicant: Uniplast Industries, Inc., Hasbrouck Heights, NJ (US)

(72) Inventors: Stuart Goldman, Wayne, NJ (US); King Keung Kennedy Chan, Pokfulam (HK)

(73) Assignee: UNIPLAST INDUSTRIES, INC., Hasbrouck Heights, NJ (US)

( * ) Notice: Subject to any disclaimer, the term of this patent is extended or adjusted under 35 U.S.C. 154(b) by 0 days.

(21) Appl. No.: 15/839,430

(22) Filed: Dec. 12, 2017

(65) Prior Publication Data

US 2018/0103785 A1 Apr. 19, 2018

Related U.S. Application Data

(63) Continuation-in-part of application No. 15/411,004, filed on Jan. 20, 2017, which is a continuation-in-part of application No. 15/151,051, filed on May 10, 2016, now Pat. No. 9,820,599.

(51) Int. Cl.
*A47G 25/40* (2006.01)
*A47G 25/32* (2006.01)

(52) U.S. Cl.
CPC ..... *A47G 25/40* (2013.01); *A47G 25/32* (2013.01)

(58) Field of Classification Search
CPC ..... A47G 25/32; A47G 25/38; A47G 25/40
USPC ..... 223/89, 94, 93, 96; 40/322
See application file for complete search history.

(56) References Cited

U.S. PATENT DOCUMENTS

| | | | | | |
|---|---|---|---|---|---|
| 3,467,291 | A * | 9/1969 | Phillips | A47G 25/32 | 223/85 |
| 4,063,670 | A * | 12/1977 | Faarbech | A47G 25/32 | 223/92 |
| 4,168,791 | A * | 9/1979 | Clark, Jr. | A47G 25/50 | 223/94 |
| 5,074,445 | A | 12/1991 | Chen | | |
| 5,085,357 | A | 2/1992 | Chen | | |
| 5,456,391 | A | 10/1995 | Chang | | |
| 5,826,759 | A * | 10/1998 | Ohsugi | A47G 25/32 | 223/85 |
| 5,975,384 | A * | 11/1999 | Manabat | A47G 25/485 | 223/91 |
| 6,000,587 | A | 12/1999 | Sackett | | |
| 6,286,735 | B1 * | 9/2001 | Zuckerman | A47G 25/483 | 223/93 |
| 7,837,074 | B2 | 11/2010 | Rude | | |
| 7,905,376 | B2 | 3/2011 | Gouldson | | |
| 8,113,393 | B2 | 2/2012 | Ho | | |
| 8,235,261 | B1 | 8/2012 | Park | | |

(Continued)

*Primary Examiner* — Nathan Durham
(74) *Attorney, Agent, or Firm* — Leason Ellis LLP

(57) ABSTRACT

A collapsible hook hanger includes a hook having a lower end and a hanger body including a cross bar having a top wall. The hanger further includes a hook receiving body extending from the top wall of the cross bar. The hook receiving body has a hook receiving slot for receiving the hook. The hanger further includes an axle member disposed within the hook receiving body and having a hole that is in communication with the hook receiving slot for receiving and mating to the lower end of the hook. The hook is rotatable between a first upright position and a second folded position. The top wall of the cross bar includes a notch that receives the hook as it is rotated to the second folded position.

21 Claims, 31 Drawing Sheets

(56) References Cited

U.S. PATENT DOCUMENTS

| | | | | |
|---|---|---|---|---|
| 9,549,630 | B2 * | 1/2017 | Hansen | A47G 25/32 |
| 9,655,466 | B1 | 5/2017 | Bernstein et al. | |
| 2002/0056735 | A1 * | 5/2002 | Lam | A47G 25/443 223/94 |
| 2006/0054646 | A1 | 3/2006 | Nathanmanna | |
| 2008/0283558 | A1 * | 11/2008 | Rude | A47G 25/32 223/94 |
| 2009/0283556 | A1 * | 11/2009 | Ho | A47G 25/32 223/85 |
| 2016/0088964 | A1 | 3/2016 | Hansen et al. | |
| 2016/0088965 | A1 | 3/2016 | Hansen et al. | |

* cited by examiner

COLLAPSIBLE HOOK HANGER

CROSS-REFERENCE TO RELATED APPLICATION

The present application is a continuation-in-part of U.S. patent application Ser. No. 15/411,004, filed Jan. 20, 2017, which is a continuation-in-part of U.S. patent application Ser. No. 15/151,051, filed May 10, 2016, now U.S. Pat. No. 9,820,599, issued Nov. 21, 2017, each of which is incorporated by reference as if expressly set forth in their respective entirety herein.

TECHNICAL FIELD

The present invention relates to garment hangers and more particularly, to a garment hanger having a collapsible hook.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of constructions to accommodate different articles that are carried by the hangers.

A traditional type of garment hanger includes a metal hook which is received in and mates to a threaded boss located on the upper frame. More specifically, one end of the metal hook is a threaded end that mates with the threaded boss. The body of the hanger is typically made of plastic.

Many times, garments that are manufactured overseas are pre-hung on a hanger and then shipped to another country as a garment/hanger combination. Upon delivery to the final retail location, the garment is simply removed from the box (packaging) and hung in the retail location. Since shipping and transportation costs are not insignificant, it is desirable to pack the garments as tight as possible in the packaging boxes/containers. However, the hooks of the garment hangers take up a significant volume of space within the packaging boxes/containers. This additional space, of course, translates into additional shipping costs.

There is therefore a need for a garment hanger that operates as a conventional hanger but is also capable of providing a reduced footprint during packaging/transportation.

SUMMARY

A collapsible hook hanger includes a hook having a lower end and a hanger body including a cross bar having a top wall. The hanger further includes a hook receiving body extending from the top wall of the cross bar. The hook receiving body has a hook receiving slot for receiving the hook. The hanger further includes an axle member disposed within the hook receiving body and having a hole that is in communication with the hook receiving slot for receiving and mating to the lower end of the hook. The hook is rotatable between a first upright position and a second folded position. The top wall of the cross bar includes a notch that receives the hook as it is rotated to the second folded position.

BRIEF DESCRIPTION OF THE DRAWING FIGURES

Figure 10A:
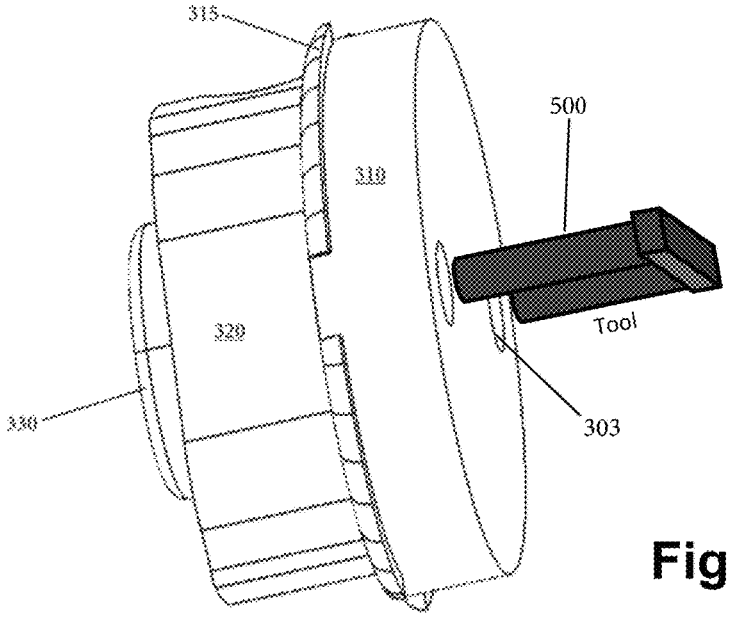
Figure 10B:
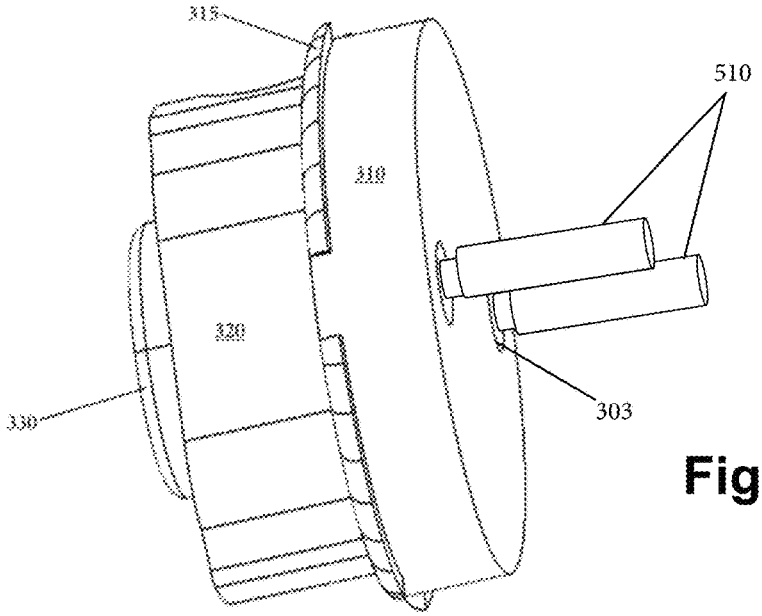
Figure 10C:
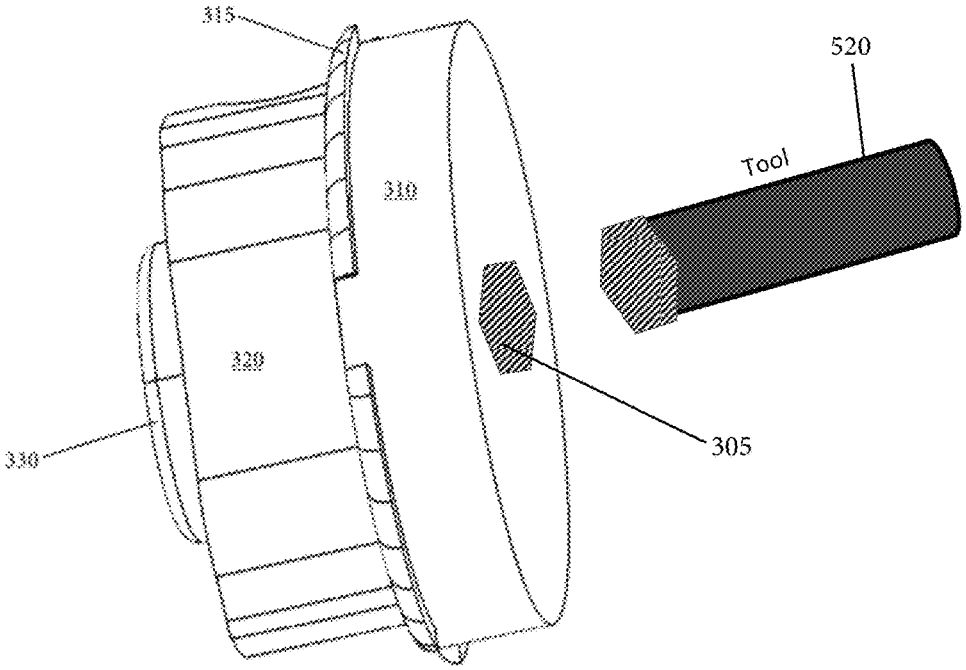
Figure 11:
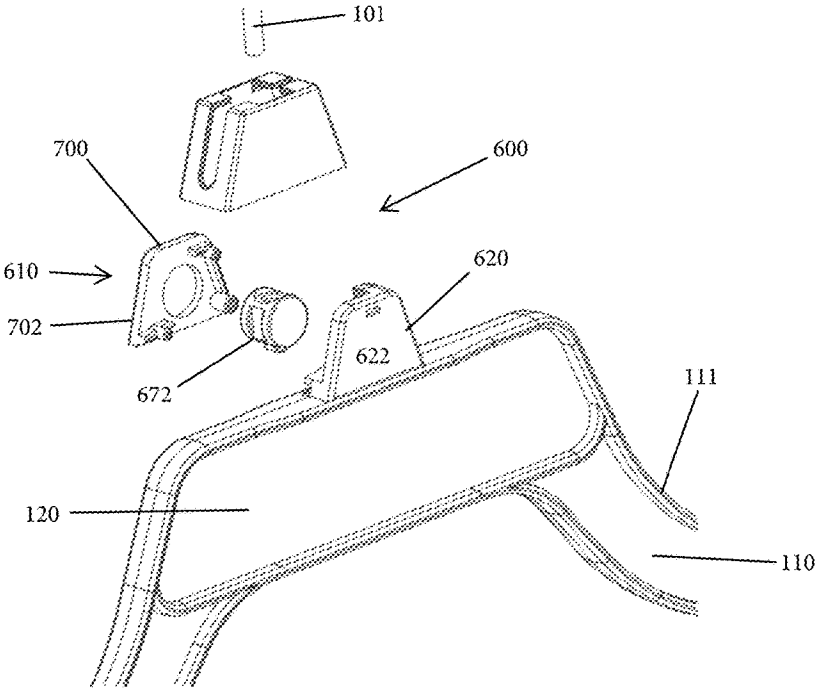
Figure 12:
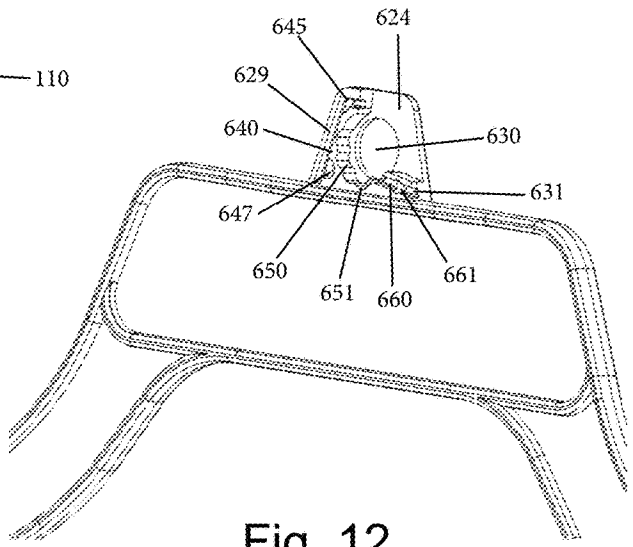
Figure 13:
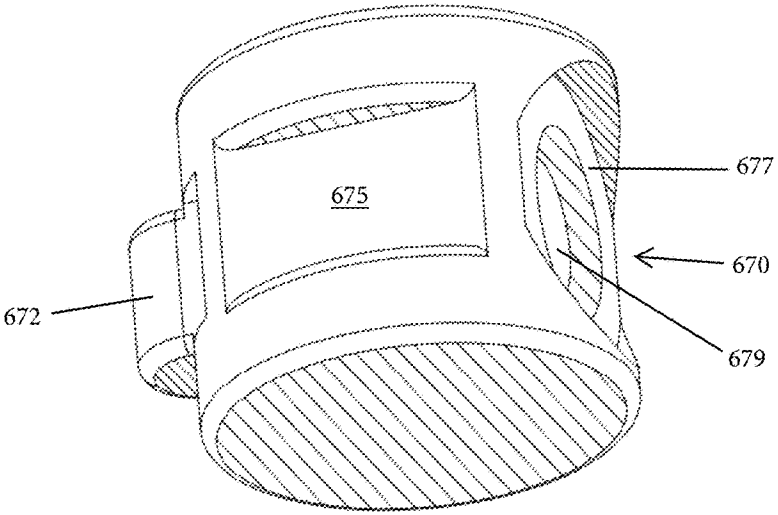
Figure 14:
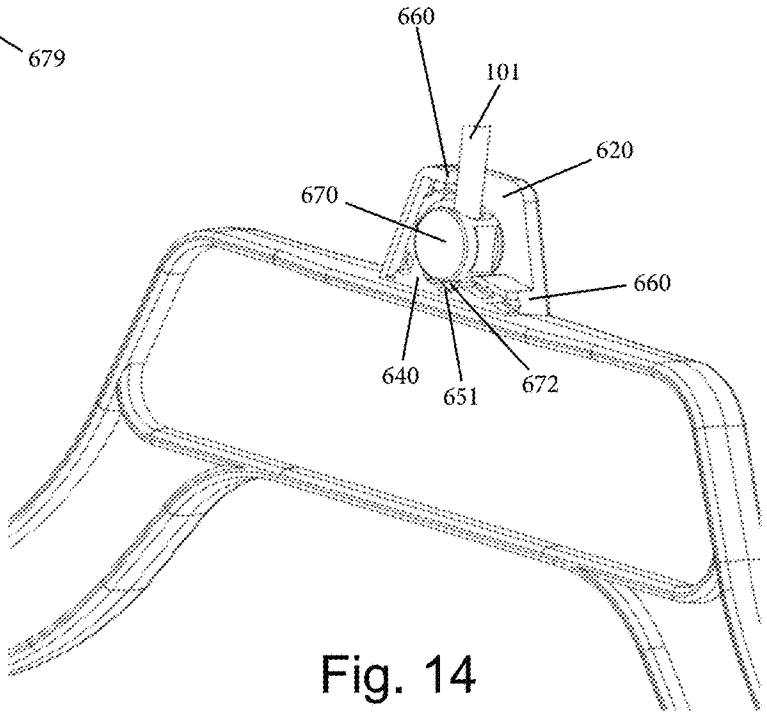
Figure 15:
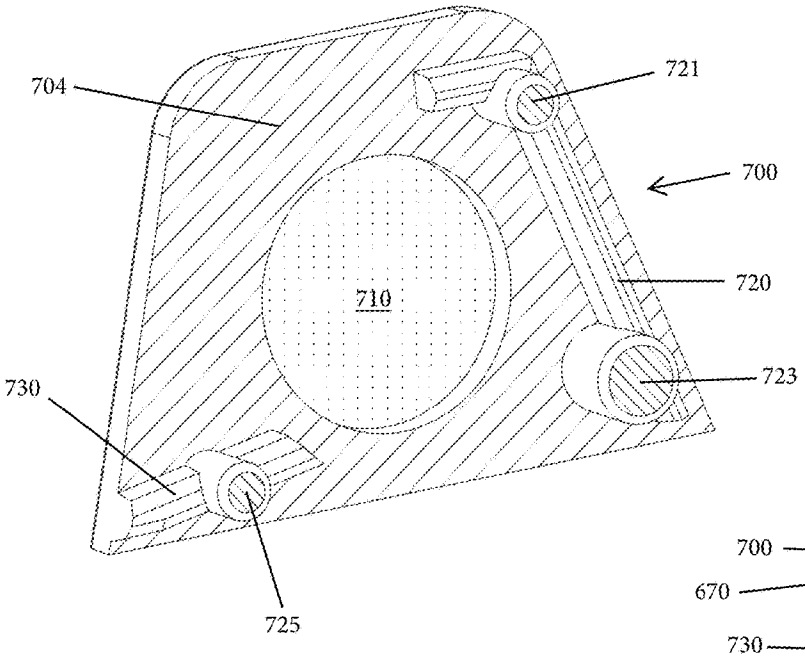
Figure 16:
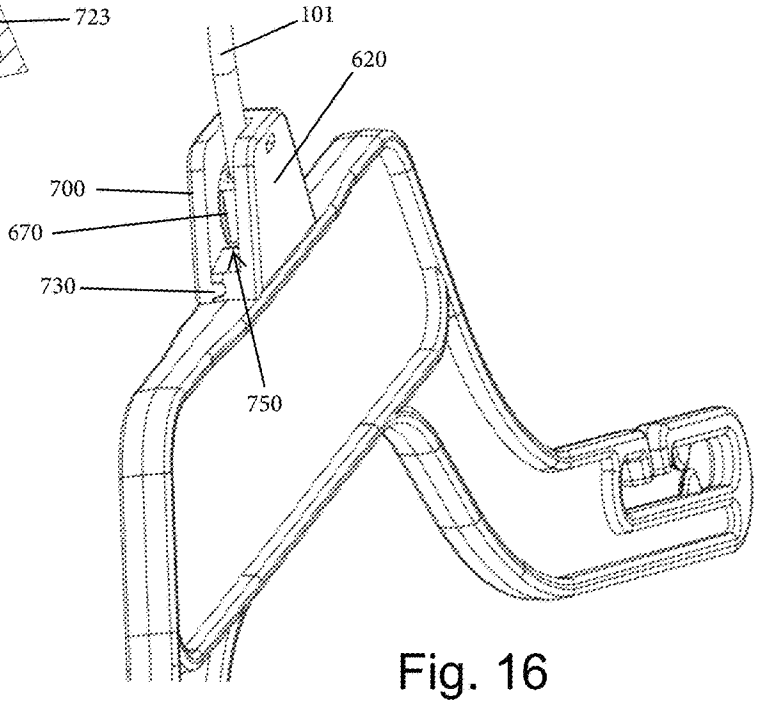
Figure 18:
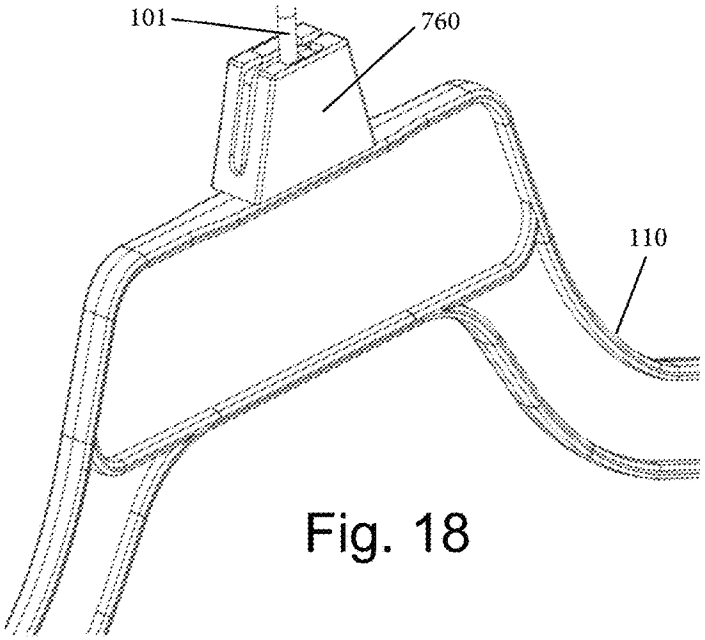
Figure 17:
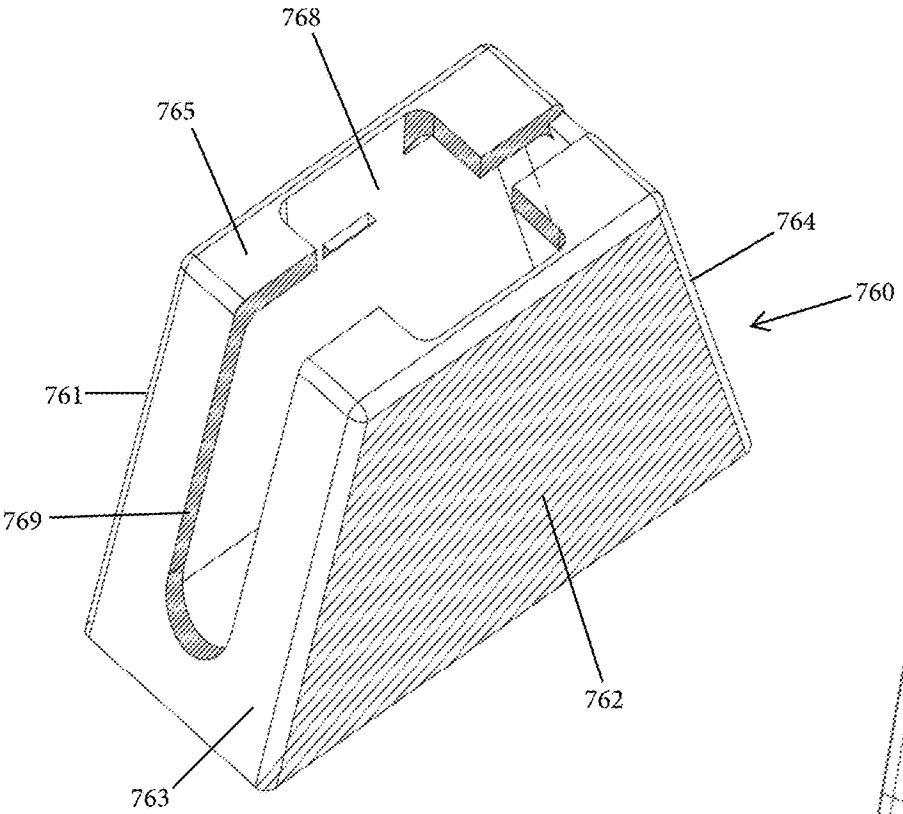
Figure 19A:
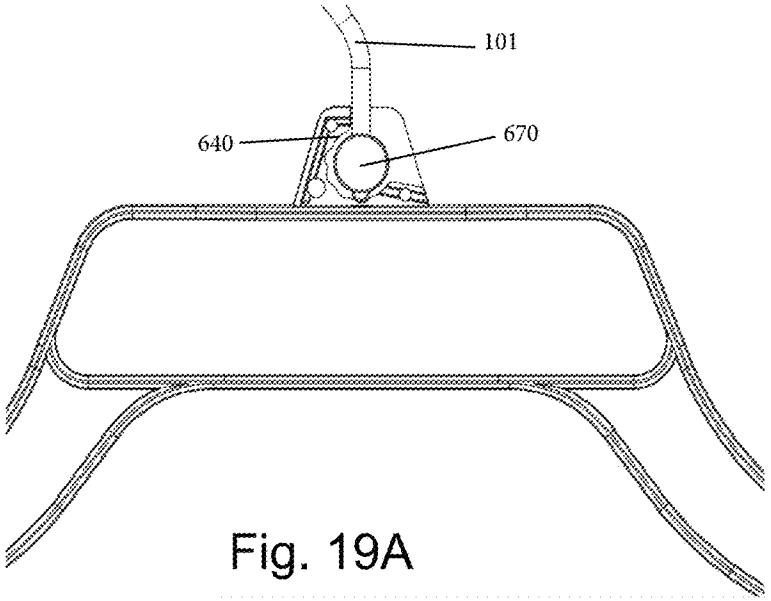
Figure 19B:
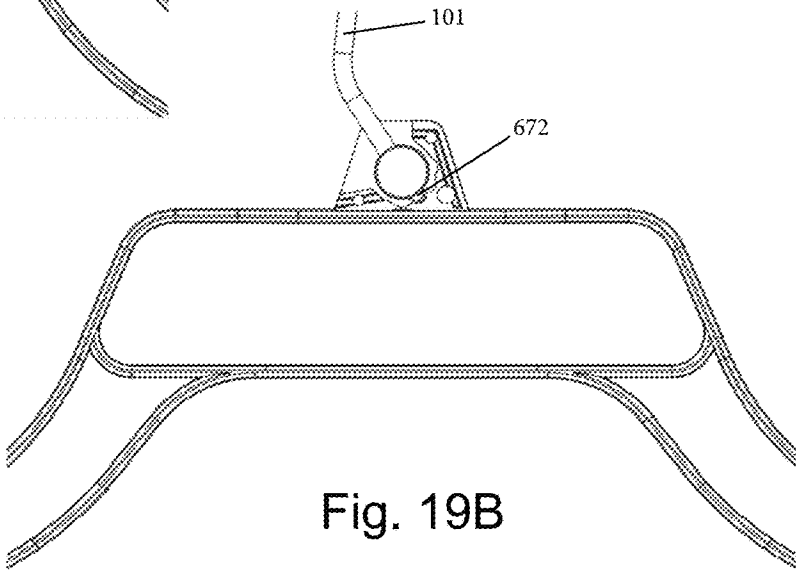
Figure 19C:
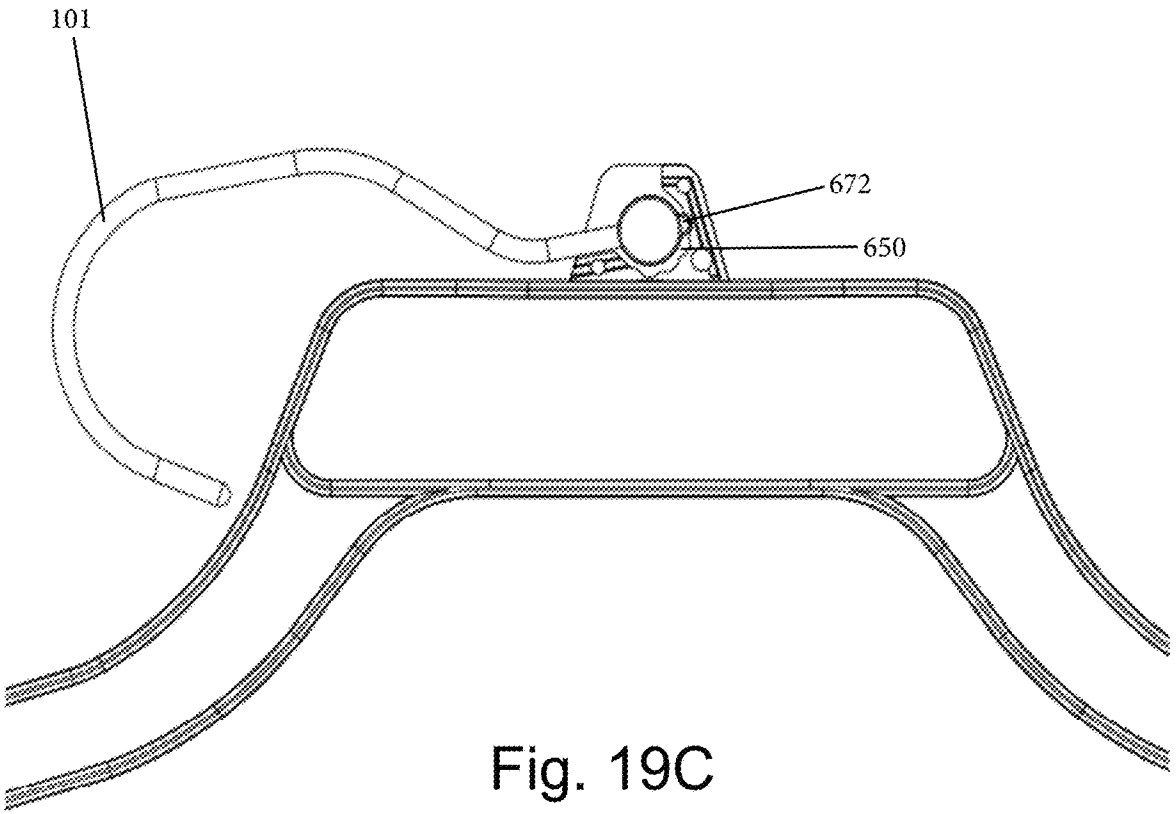
Figure 20:
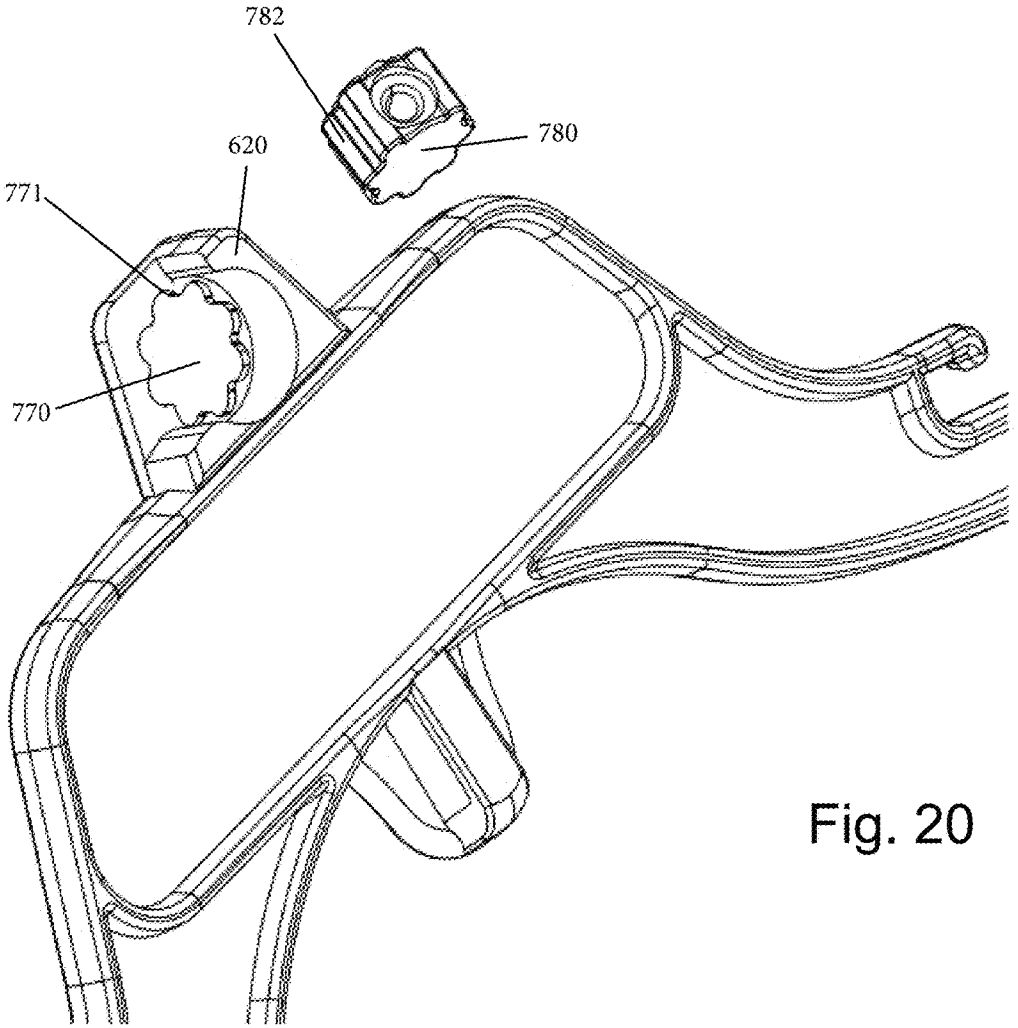
Figure 21B:
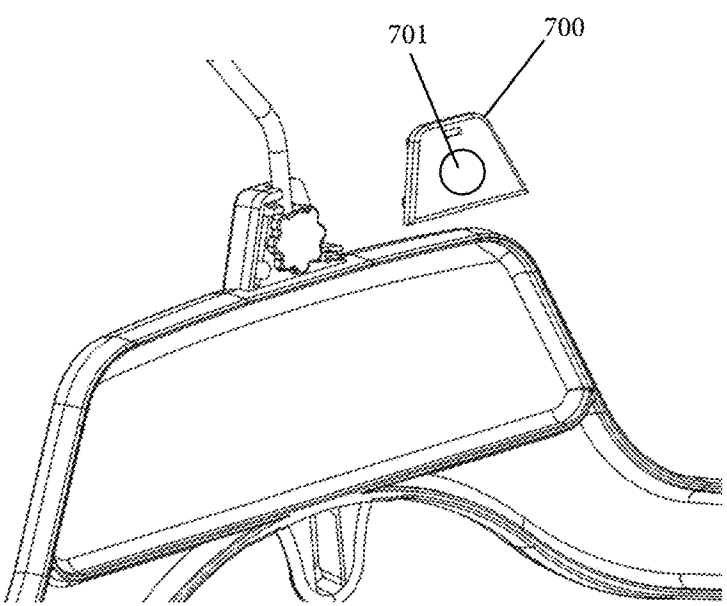
Figure 21A:
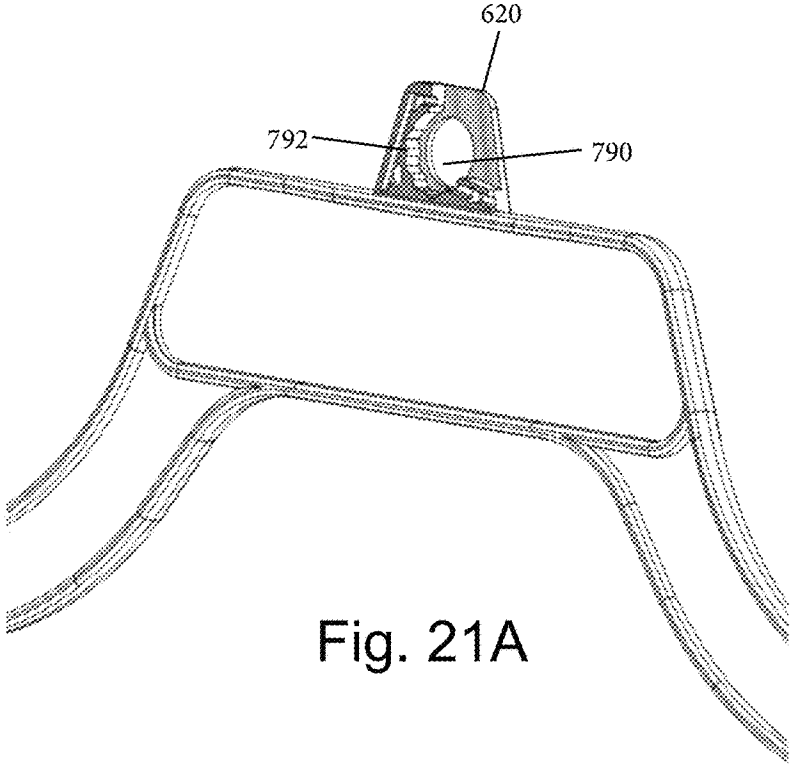
Figure 22:
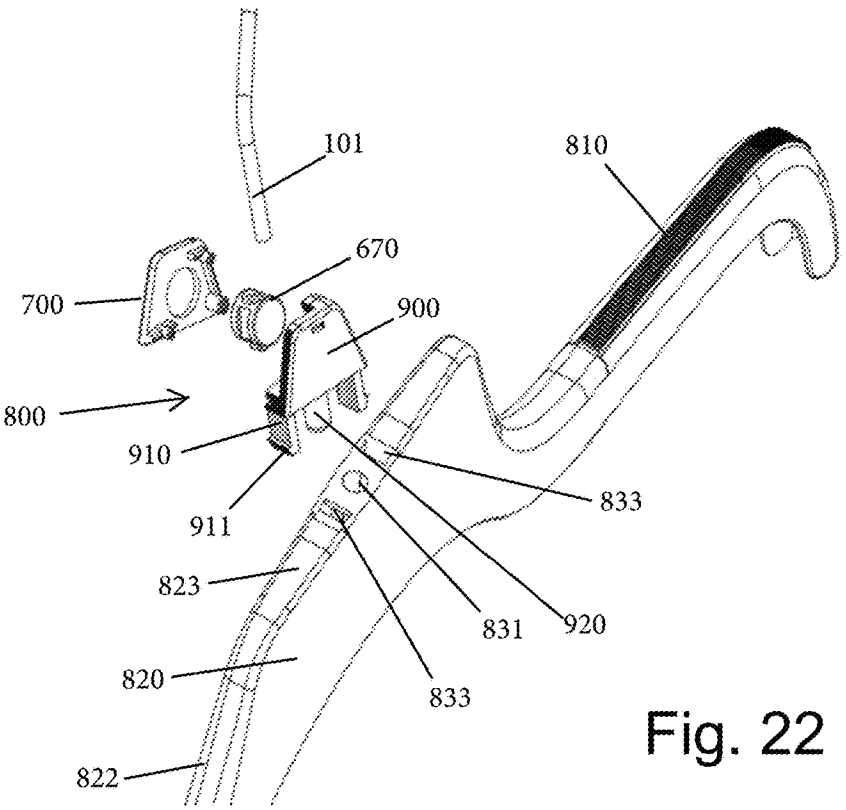
Figure 23B:
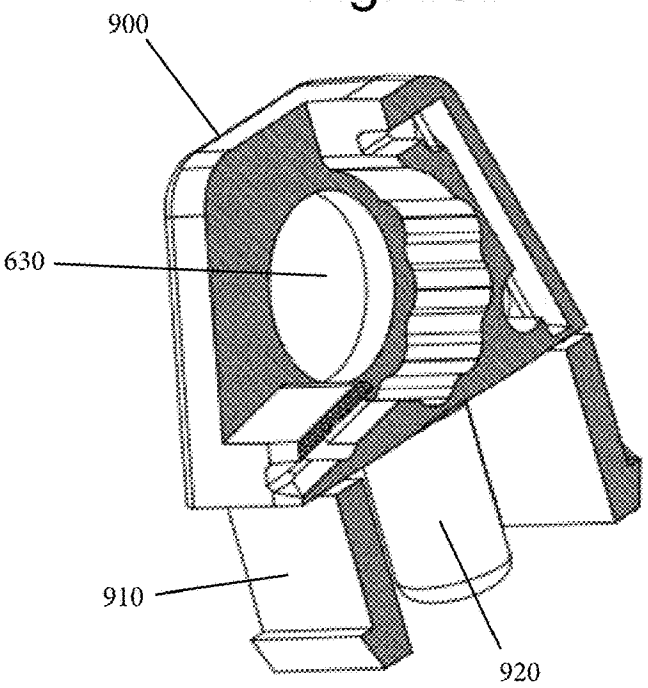
Figure 23A:
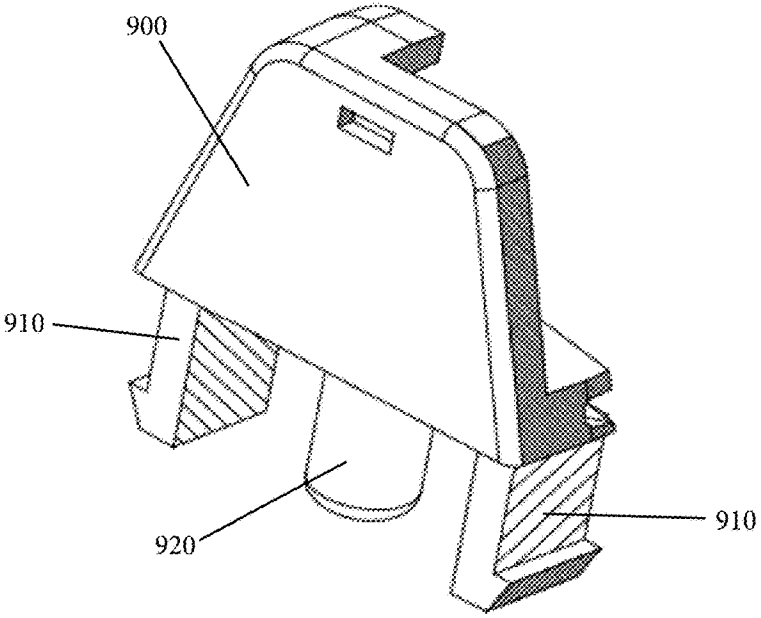
Figure 24B:
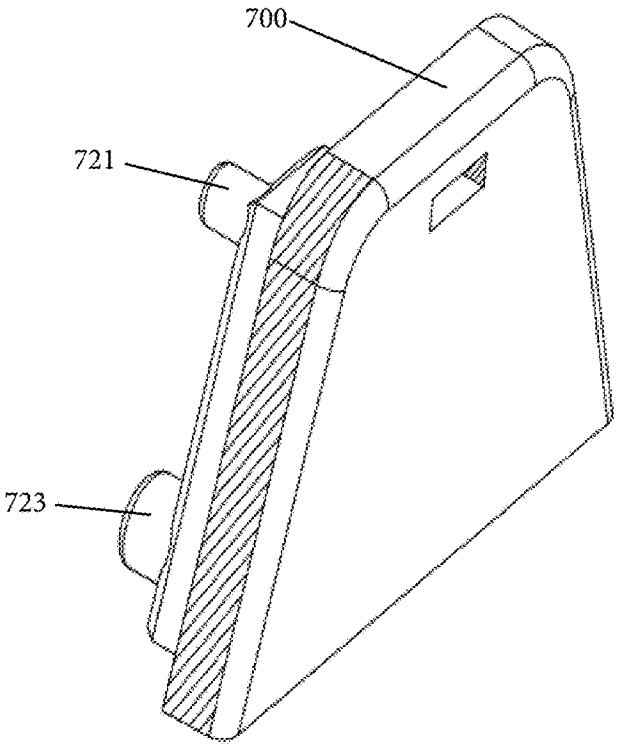
Figure 24A:
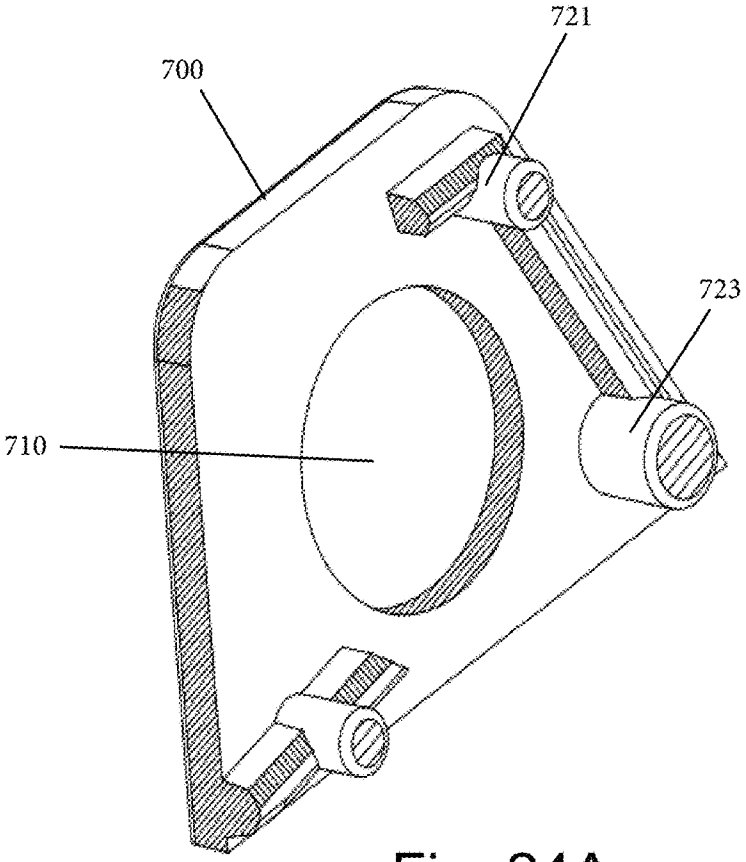
Figure 25:
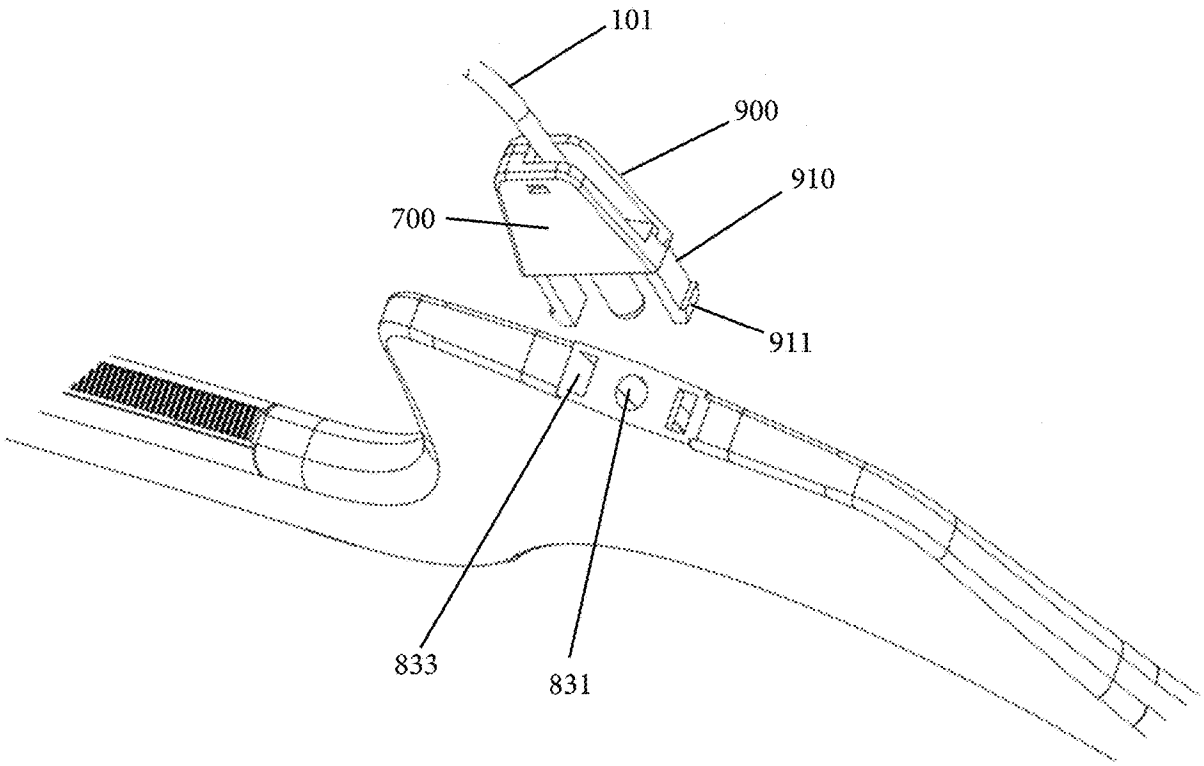
Figure 26:
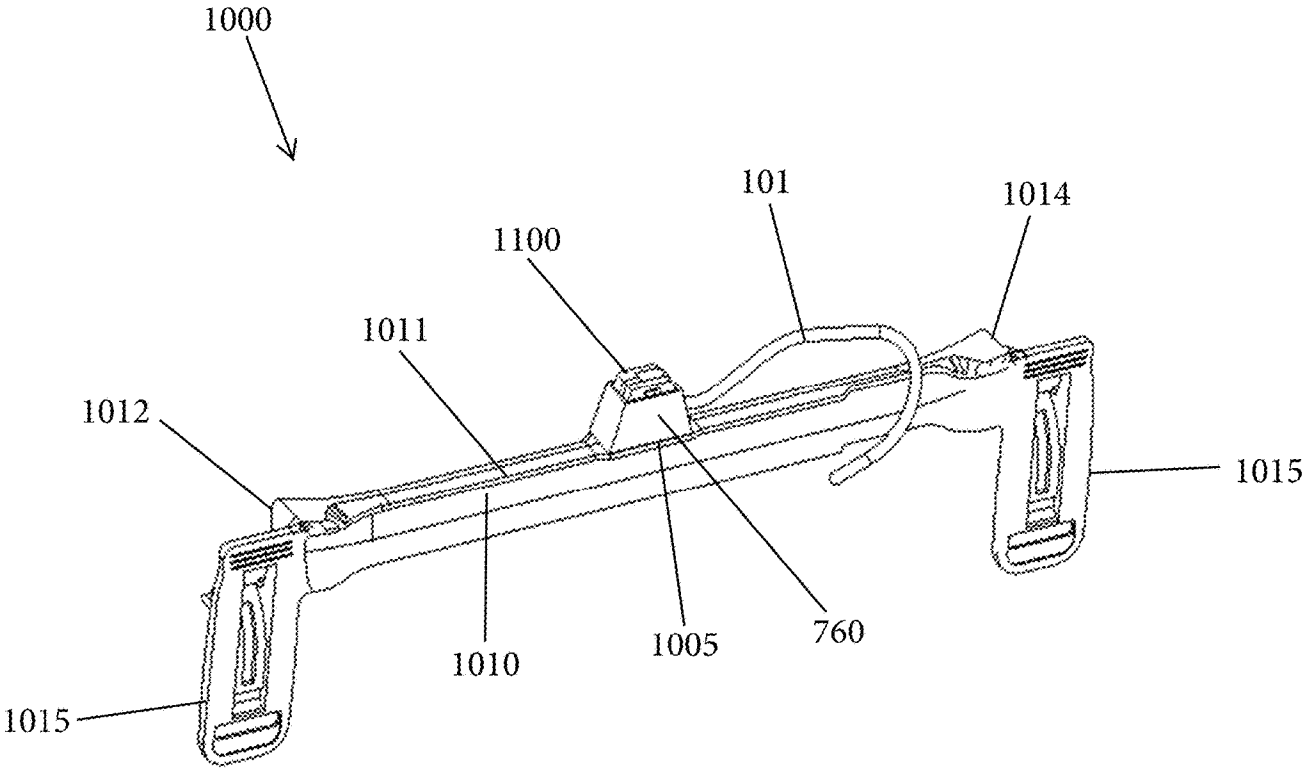
Figure 27:
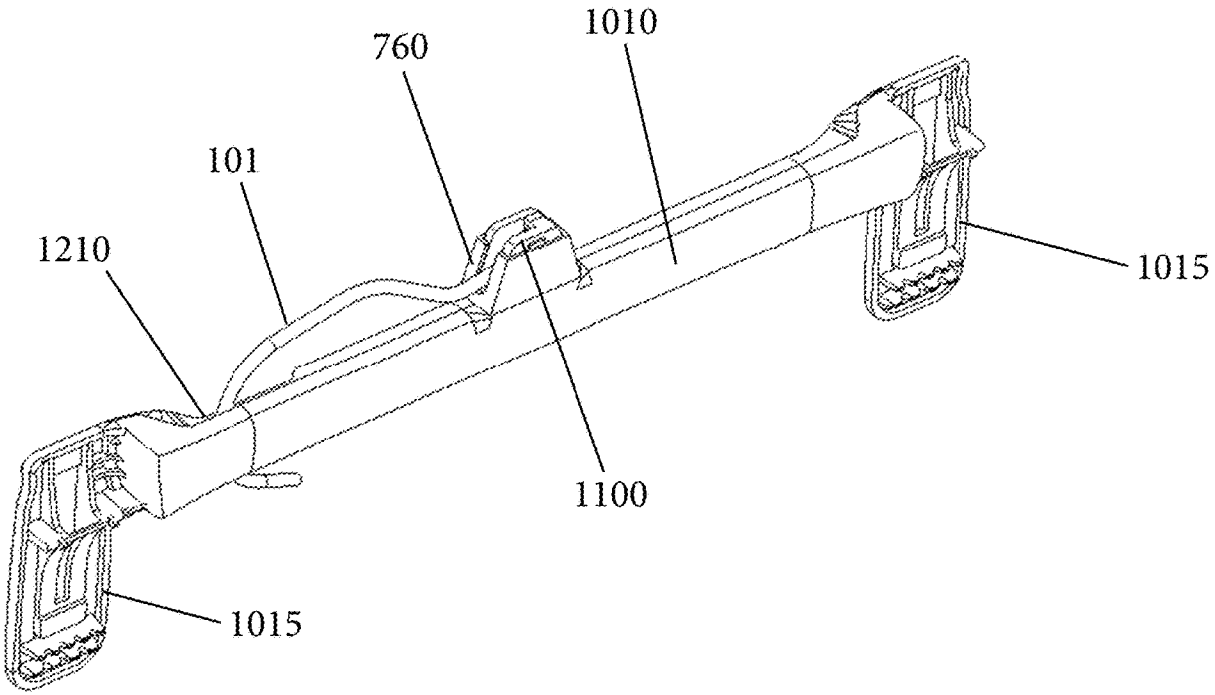
Figures 28A, 28B:
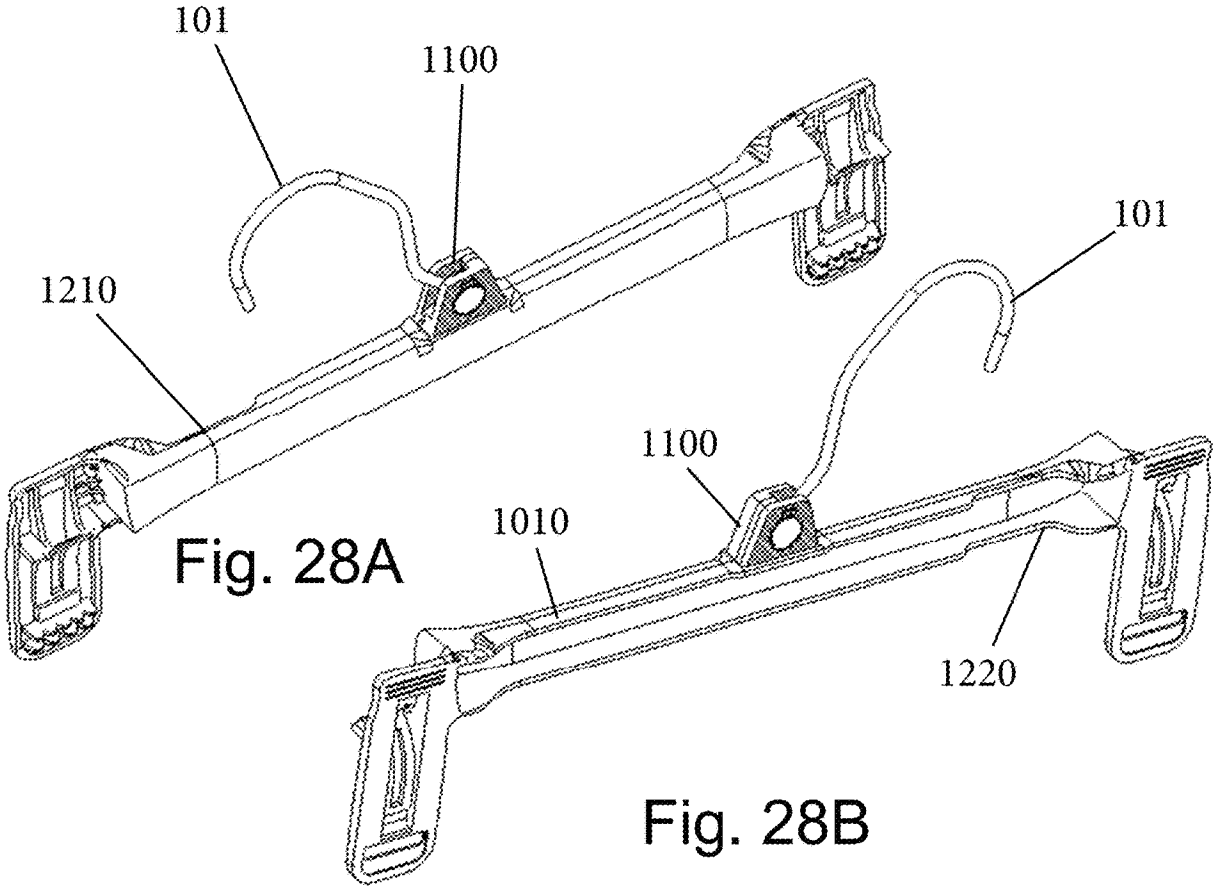
Figure 29:
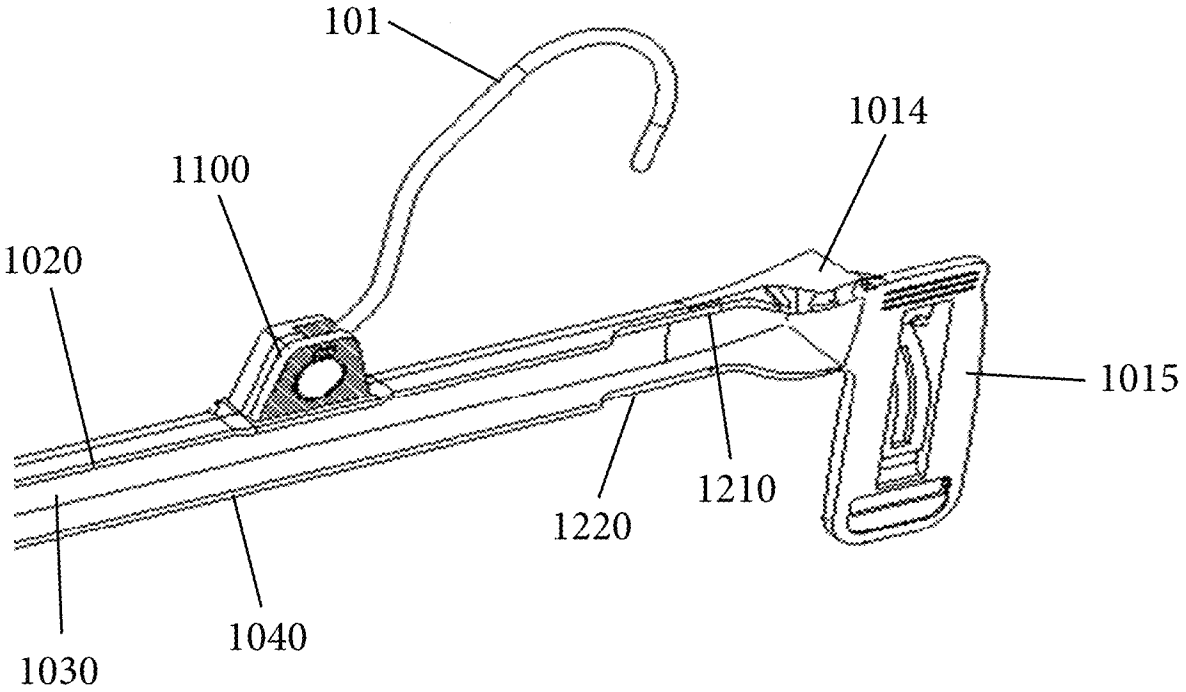
Figure 30:
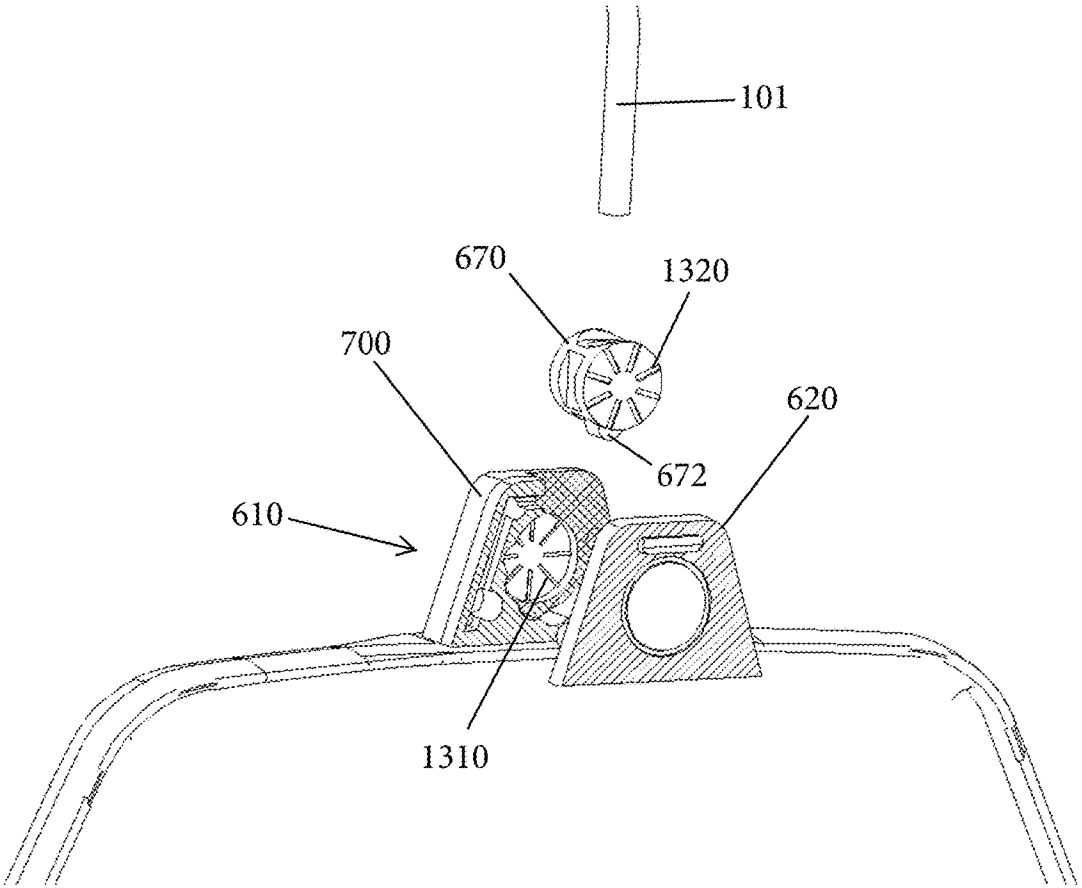
Figure 31:
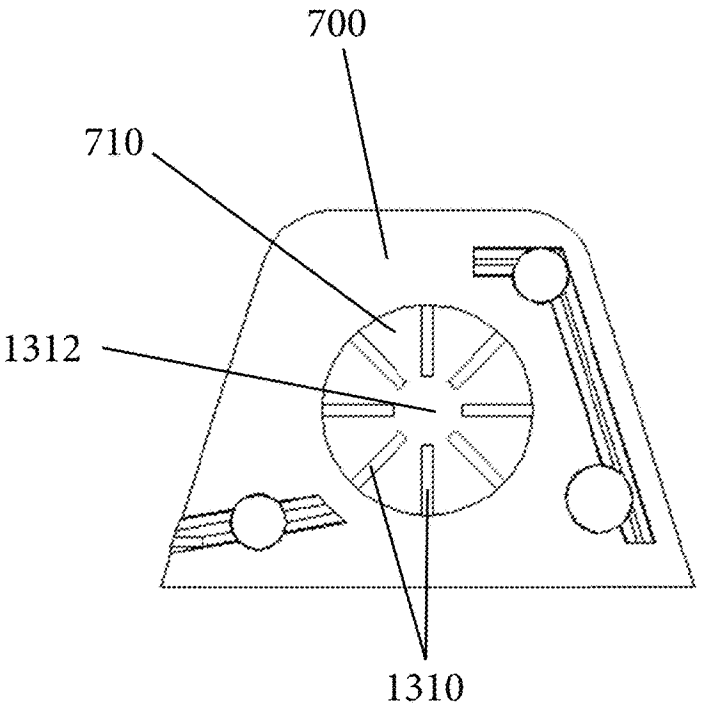
Figure 32:
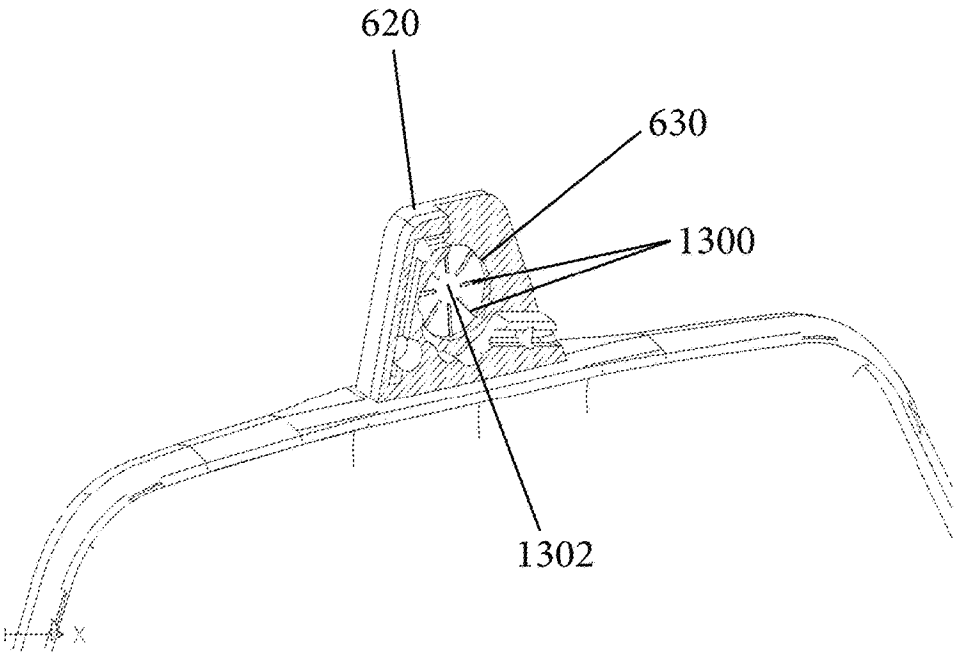
Figure 33:
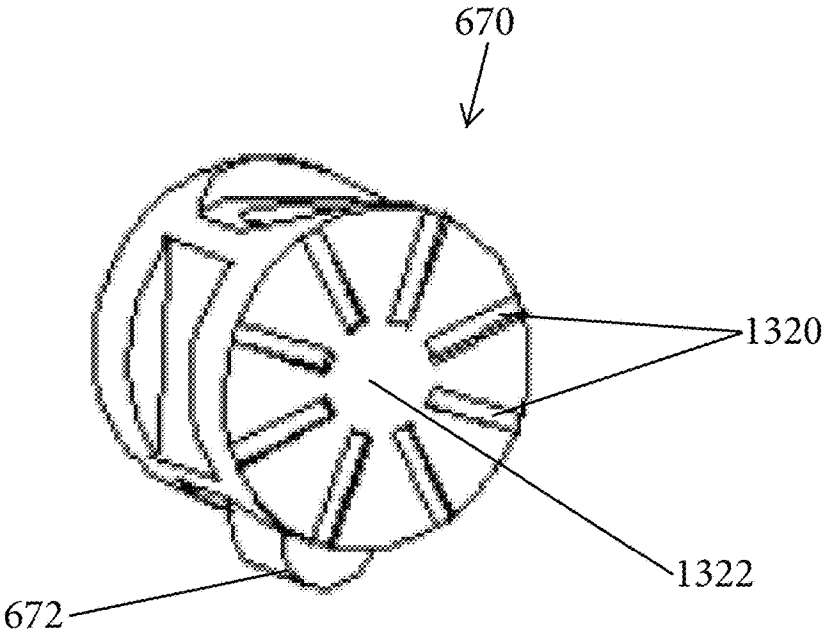

FIGS. 10A-C illustrate the use of a tool to stabilize the axle member while the hook is mated thereto;

FIG. 11 is an exploded view of a collapsible hook for a garment hanger according to another embodiment;

FIG. 12 is a perspective view of a first side wall of the collapsible hook of FIG. 11;

FIG. 13 is a perspective view of an axle drum that forms part of the collapsible hook of FIG. 11;

FIG. 14 is a perspective view showing the axle drum inserted into a cavity of the first side wall;

FIG. 15 is a perspective view of a second side wall that is configured for attachment to the first side wall;

FIG. 16 is a perspective view of the first and second side walls attached to one another with the axle drum;

FIG. 17 is a perspective view of a sizer for use with the collapsible hook of FIG. 11;

FIG. 18 is a perspective view showing placement of the sizer over the collapsible hook;

FIGS. 19A-C show rotation of the axle drum into different positions within the first side wall resulting in pivoting of the hook;

FIG. 20 is an exploded perspective view of a first side wall and axle drum according to a different embodiment;

FIG. 21A is a perspective view of a first side wall according to a different embodiment;

FIG. 21B is another perspective view of a second side wall of the embodiment of FIG. 21A;

FIG. 22 is an exploded perspective view of a collapsible hook according to yet another embodiment;

FIG. 23A is a perspective view of an outer surface of a first side wall of the collapsible hook;

FIG. 23B is a perspective view of an inner surface of the first side wall of the collapsible hook;

FIG. 24A is a perspective view of an outer surface of a second side wall of the collapsible hook;

FIG. 24B is a perspective view of an inner surface of the second side wall of the collapsible hook;

FIG. 25 is an exploded perspective view of a collapsible hook assembly configured for insertion into and attachment of a center portion of a garment hanger beam;

FIG. 26 is rear perspective view of a garment hanger with a collapsible hook according to another embodiment showing the hook in a lowered position;

FIG. 27 is front perspective view of the garment hanger of FIG. 26 with the hook in the lowered position;

FIG. 28A is front perspective view of the garment hanger of FIG. 26 with the hook in a partially raised position;

FIG. 28B is rear perspective view of the garment hanger of FIG. 26 with the hook in a partially raised position;

FIG. 29 is a close-up rear perspective view of an end portion of the cross member of the garment hanger;

FIG. 30 is an exploded perspective view of a collapsible hook for a garment hanger according to another embodiment;

FIG. 31 is a rear elevation view of a second side wall that partially forms a hook receiving body of the hanger of FIG. 30;

FIG. 32 is a rear perspective view of a first side wall that partially forms the hook receiving body; and FIG. 33 is a perspective view of a rotatable drum for use in the hook receiving body of FIG. 30.

DETAILED DESCRIPTION OF CERTAIN EMBODIMENTS

FIGS. 1-3, 7 and 8 illustrate an exemplary garment hanger 100 that includes a crossbar 110 that defines a first end 112 and an opposing second end 114. Hanger 100 also includes a central portion 120 that defines a hook receiving area. In particular, the central portion 120 includes a hook receiving body 200 that is integral to and extends outwardly from a top edge 111 of the cross bar 110.

The hook receiving body 200 is defined by a first side wall 210, an opposing second side wall 220, a first end wall 230 that connects the first side wall 210 and the second side wall 220, and a second end wall 240 that also connects the first side wall 210 and the second side wall 220. The first and second side walls 210, 220 are parallel to one another and the first side wall 210 can be thought of as being a front wall and the second side wall 220 can be thought of as being a rear wall. The first and second end walls 230, 240 can be angled (other than 90 degrees) relative to the top edge of the cross bar 110.

The four walls 210, 220, 230, 240 define a hollow interior space 245 that is open along its top since there is no wall structure that extends across the top edges of the four walls 210, 220, 230, 240. Thus, the hook receiving body 200 includes a top opening 201 which, as described below, is configured to receive a hook 101.

The first end wall 230 can be a completely solid wall that extends between the first and second side walls 210, 220. In contrast, the second end wall 240 includes an opening that communicates with the top opening so as to define a generally L-shaped hook receiving slot 235.

The first side wall 210 has an opening 240 formed therein. More specifically, the opening 240 defines an entrance into the hollow interior space 245 defined within the hook receiving body 210. The opening 240 is a through hole that can have any number of different shapes and in the illustrated embodiment, the opening 240 has a generally circular shape. The opening 240 can be centrally formed in the first side wall 210.

The opposing second side wall 220 has an exterior surface 221 and an opposing interior surface 223. The second side wall 220 is a completely solid structure unlike the first side wall 210 that includes the opening 240. The exterior surface 221 is preferably a smooth surface, while the interior surface 223 has a recess 250 integrally formed therein. The recess 250 has a defined shape and size. It will be appreciated that the recess 250 can have any number of different shapes and different sizes and in the illustrated embodiment, the recess 250 has a generally circular shape. The recess 250 also has a selected depth as described herein; however, the recess 250 is not a through hole as shown.

The recess 250 is axially formed with the opening 240 and in one embodiment, the axis is a central axis that passes through the centers of both the recess 250 and the opening 240 even though the size of the recess 250 is different than the size of the opening 240. As shown, the recess 250 has a smaller diameter relative to the diameter of the opening 240.

The garment hanger 100 also includes an axle member 300 that is configured to be securely attached to the hook of the hanger. As mentioned, the hook is often formed of metal and has a threaded end. The axle member 300 is a substantially solid structure; however, the axle member 300 does include a threaded bore 301 which is configured to receive the threaded end of the hook so as to securely attach the hook to the axle member 300. It is possible that the axle member 300 can be thought of as being a plug or a barrel.

As shown in the figures, the axle member 300 can be thought of as an integral multi-portioned structure. In other words, the axle member 300 has a series of stacked sections (portions) as described herein. More specifically, the axle member 300 includes a first section 310, a second section 320 and a third section 330, with the second section 320 being located between the first and third sections 310, 330.

The third section 330 is configured to be intimately received within the recess 250. The third section 330 is rotatably received within the recess 250 and therefore has a complementary shape and size relative to the shape and size of the recess 250. In the illustrated embodiment, the recess 250 has a circular shape and thus, the third section 330 which is in the form of a protrusion that extends outwardly from one face of the second section 320 also has a circular shape.

The shape of the third section 330 is selected such that the third section 330 is free to rotate within the recess 250. The fit between the third section 330 and the recess 250 assists in holding the axle member 200 in place within the hollow interior space 245. As shown in the figures, the thickness (height) of the third section 330 is much less than the thicknesses of each of the second section 320 and the first section 310. In other words, the thickness of the third section 330 is selected so as to securely and rotatably couple the axle member 300 to the hook receiving body 200 without having the third section 330 inadvertently slip or otherwise fall out of the recess 250 during rotation therein, etc.

When the axle member 300 is inserted into the hollow interior space 245, the third section 330 represents the innermost section of the axle member 300, while the first section 310 represents the outermost section of the axle member 300 which is visible within the opening 240 of the first side wall 210.

The second section 320 can have any number of different shapes and in the illustrated embodiment, the second section 320 has an oblong or oval shape. The shape of the second section 320 is at least in part dictated by the fact that the second section 320 is the portion that receives the threaded end of the hook. The second section 320 thus contains the threaded bore 301 that threadingly mates with the threaded end of the hook so as to securely attach the hook to the axle member 300. As shown, the threaded bore 301 is formed in one end of the second section 320.

As shown, the second section 320 has a greater footprint than the third section 330 and actually surrounds the third section 330. A first shoulder 323 is formed between the second section 320 and the third section 330. A second shoulder 325 is formed between the second section 320 and the first section 310.

The first section 310 is configured to be received within the opening 240. The illustrated first section 310 has a disk shaped base 319 (e.g., circular shaped section) with the second section 320 being integral thereto and extending outwardly from one face 311 of the disk shaped base 319 of the first section 310. The face 311 of the disk shaped base 319 includes a peripheral rim (locking ridge) 315 that extends around a periphery of the first section 310 at the face 311. The peripheral rim 315 extends radially outward from the face 311 of the disk shaped base 319 so as to create the peripheral rim 315 which overhangs the remaining body 319 of the first section 310. Since the illustrated first section 310 has a circular shape, the illustrated peripheral rim 315 likewise has a circular shape. As shown, the peripheral rim 315 can include a plurality of notches 317 formed therein and spaced apart from one another. As shown in the figures, the peripheral rim 315 extends not only above the face 311 but also extend radially outward therefrom so as to create the overhang.

The peripheral rim 315 can generally have a general triangular shape as shown. This triangular shape is thus defined by a beveled/sloped edge 316 and a flat undercut edge 318. The undercut edge 318 lies in a plane that is parallel to the plane that contains the face 311.

The peripheral rim 315 acts as a locking ridge to securely attach the axle member 300 within the hollow interior space 245 of the hook receiving body 200 yet still permit the axle member 300 to freely rotate within the interior space 245 so as to allow the axle member 300 to assume one of a plurality of positions which when the hook is attached to the hook receiving body 200 allows the pivot relative to the hook receiving body 200. This pivoting action of the hook receiving body 200 translates into pivoting of the hook between an extended (upright) position and a collapsed (folded) position. In particular, the disk shaped base 319 has dimensions (e.g., diameter) that is only slightly less than the dimensions (e.g., diameter) of the opening 240; however, the peripheral rim 315 has dimensions (e.g., diameter) that is slightly greater than the dimensions (e.g., diameter) of the opening 240. The peripheral rim 315 is configured and formed of a material (e.g., plastic) that allows for at least slight flexing thereof to allow a mechanical (interference) fit to be achieved between the axle member 300 and the hook receiving body 200. More specifically, when the axle member 300 is inserted into the hollow interior space 245 through the opening 240, the beveled edge 316 first contacts the outer face of the first side wall 210 and due to its beveled nature, the edge 316 acts as a cam, thereby causing a flexing of the peripheral rim 315.

Figure 1:
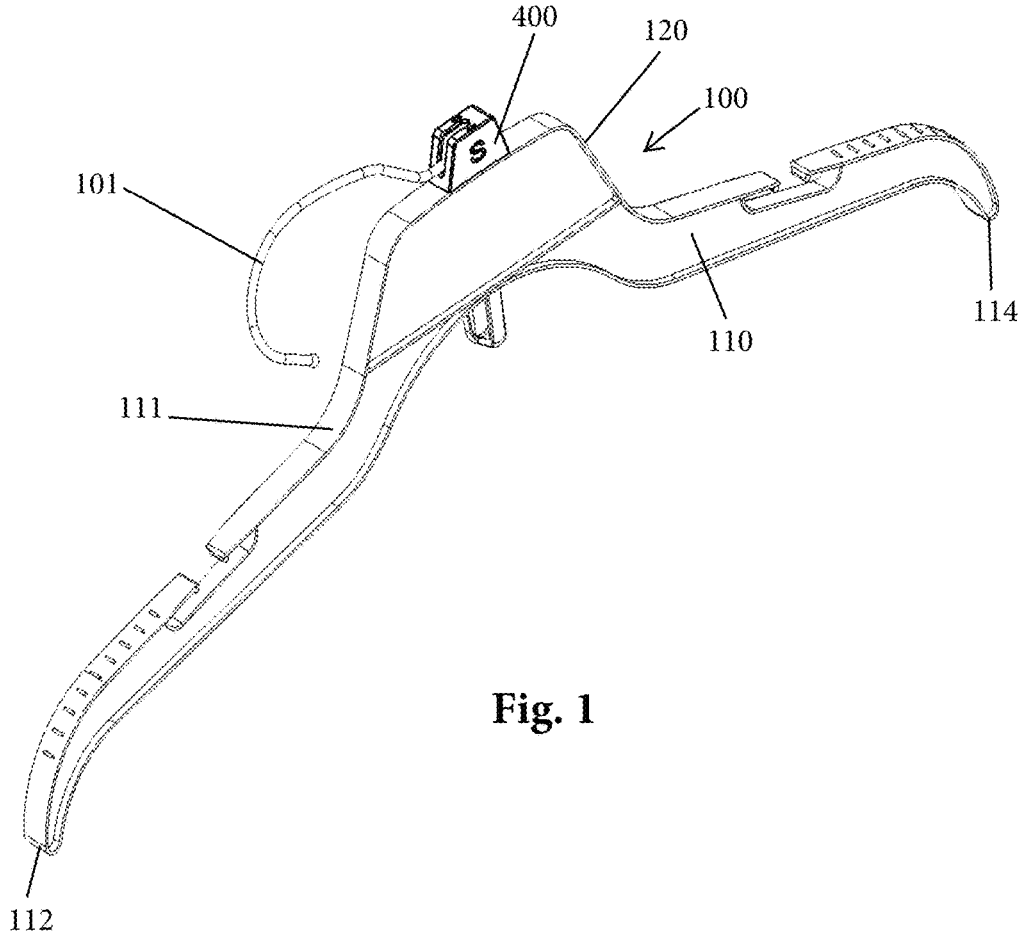
FIG. 1 is a top and side perspective view of a garment hanger with a collapsible hook.
Figure 2:
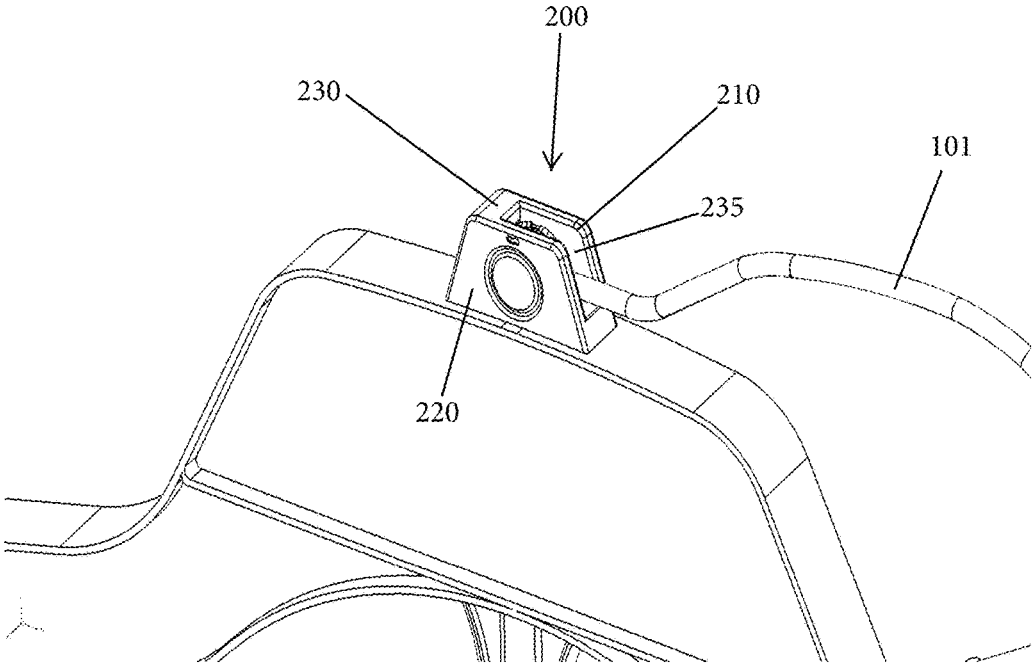
FIG. 2 is a close-up first side perspective view of a hook receiving body that mates with a hook of the hanger.
Figure 3:
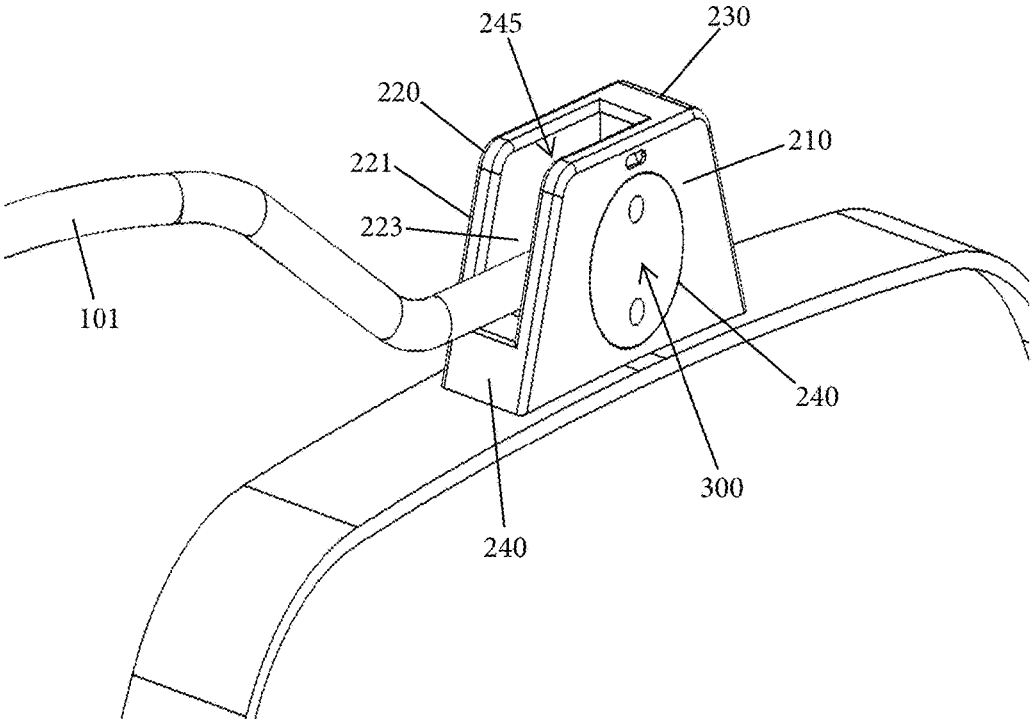
FIG. 3 is a close-up second side perspective view of the hook receiving body.
Figure 4:
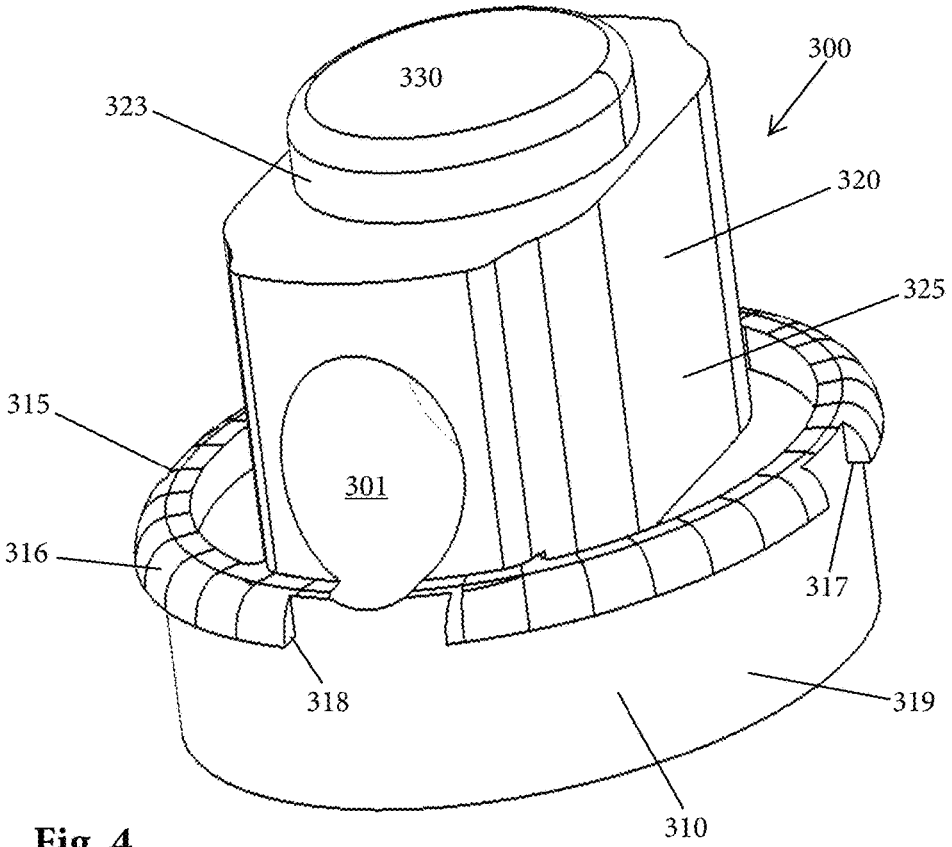
FIGS. 4-6 are perspective views of an axle member that is rotatably received in the hook receiving body.
Figure 5:
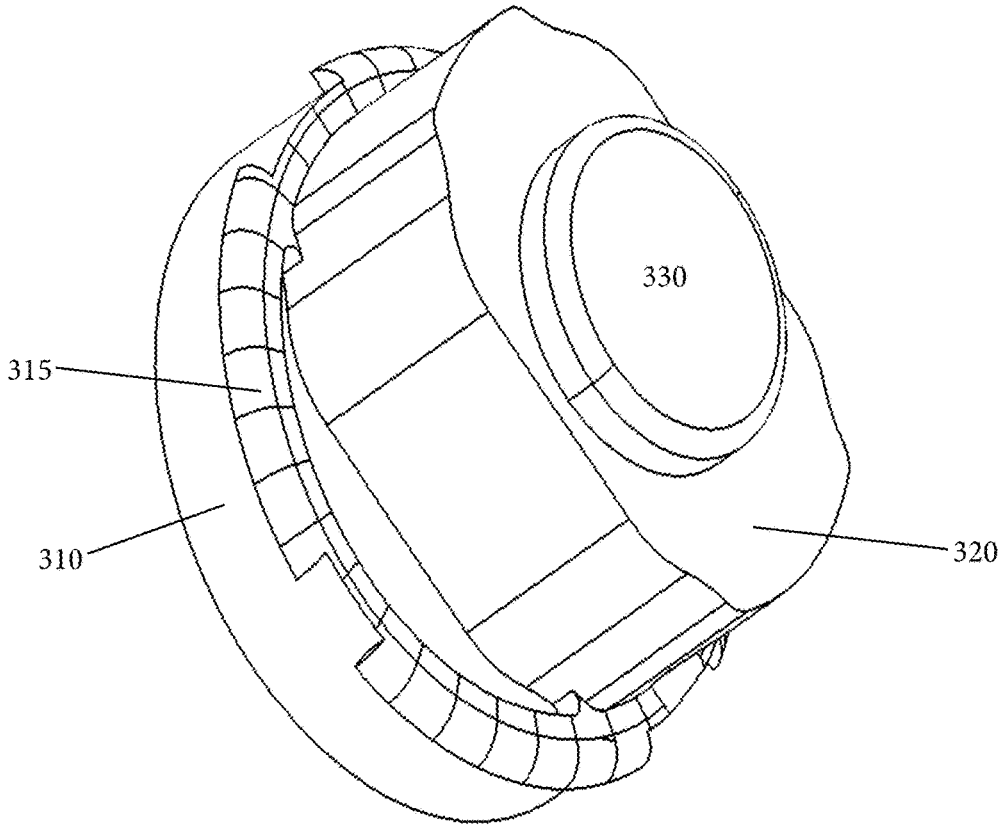
Figure 6:
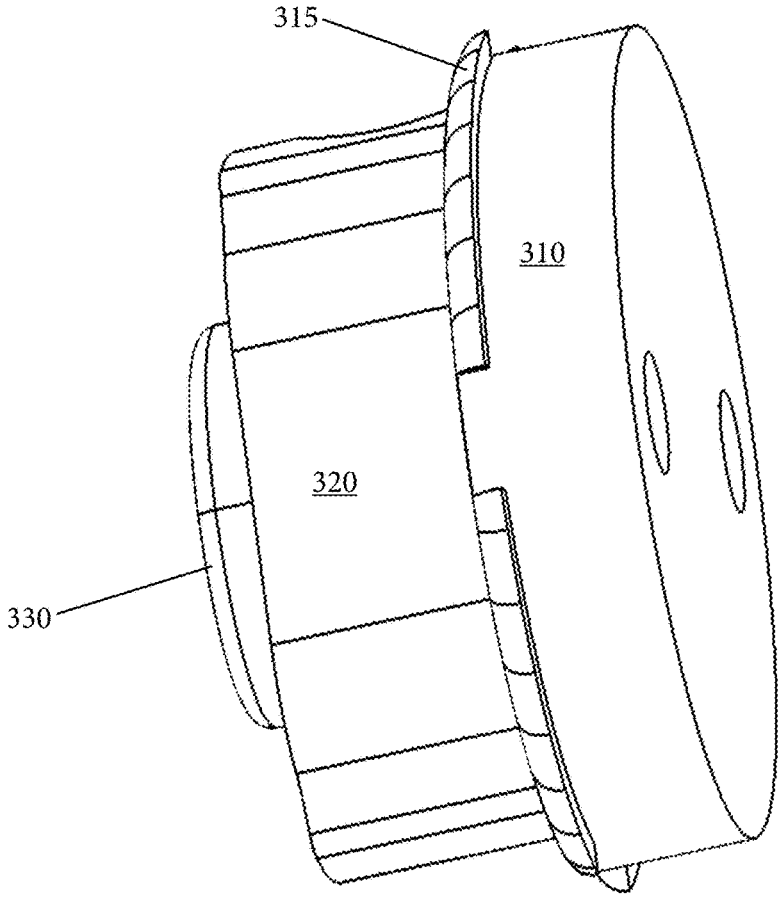
Figure 7:
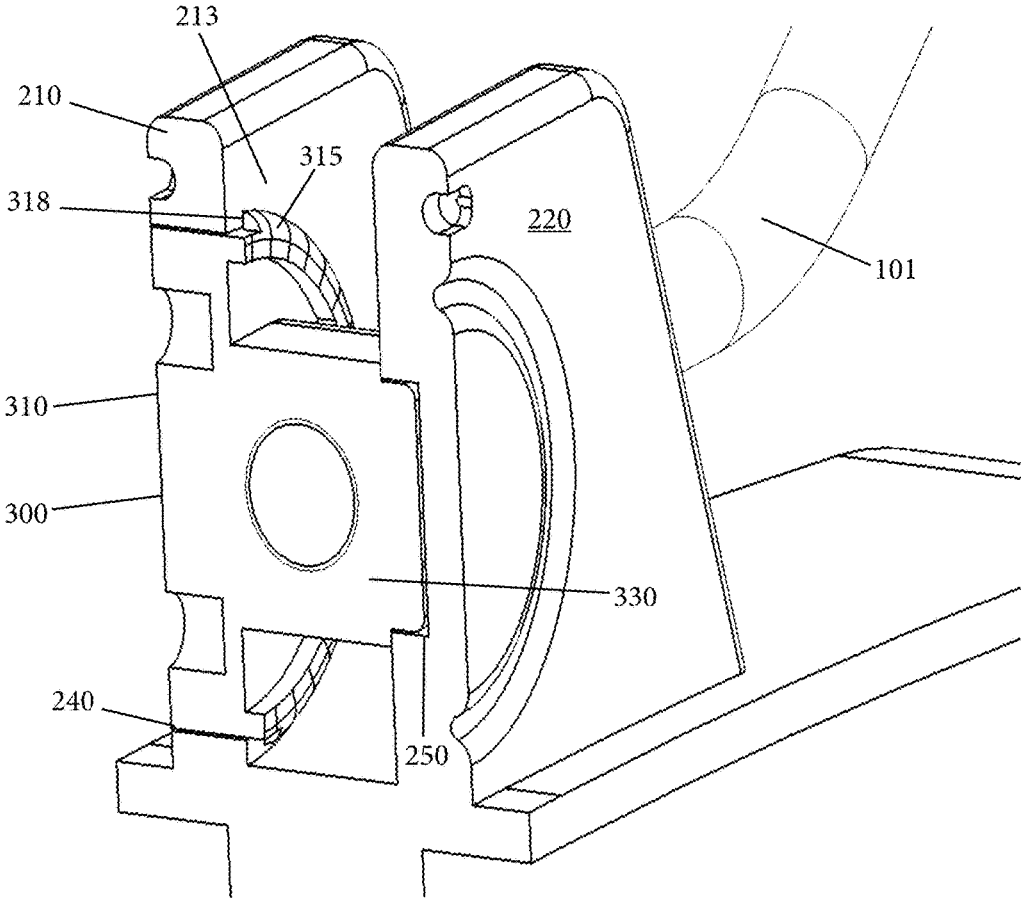
FIGS. 7-8 are cross-sectional views through the hook receiving body and axle member attached thereto.
Figure 8:
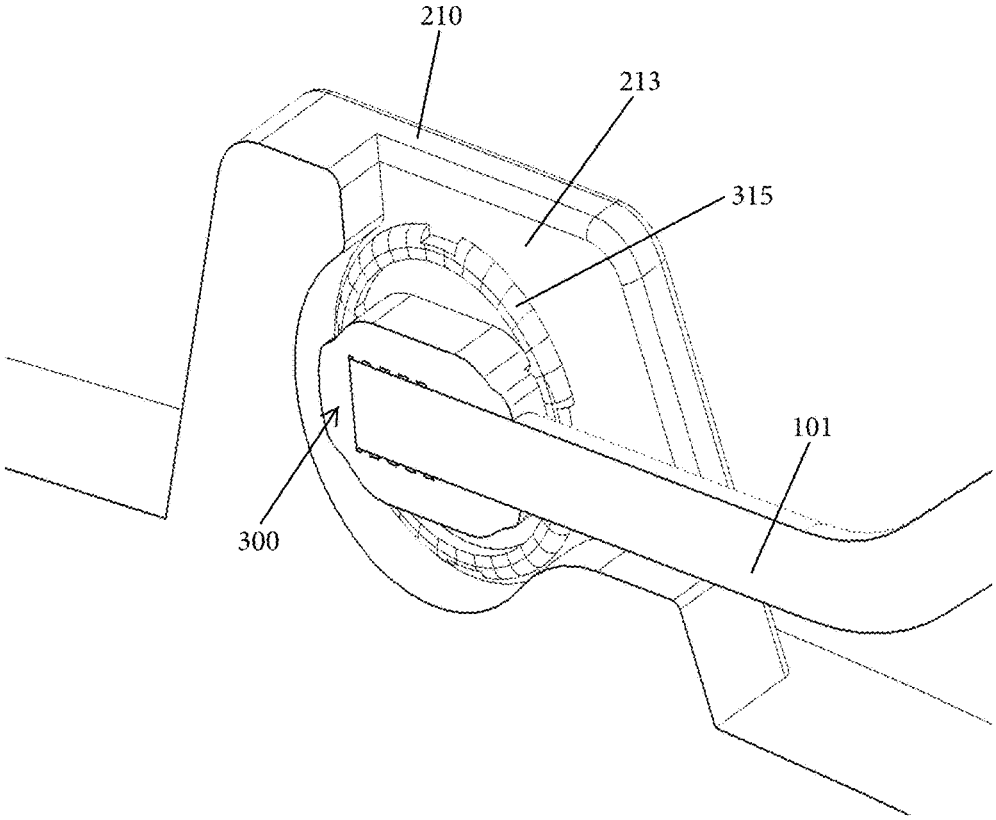

Once the axle member 300 is inserted a sufficient distance, as described below, the peripheral rim 315 clears an inner face 213 of the first side wall 210, the peripheral rim 315 flexes outward to return to its at rest (relaxed) position. As shown in FIG. 7, when the peripheral rim 315 assumes this locked position, the undercut edge 318 seats against the inner face 213 of the first side wall 210. Thus, a snap fit results between the axle member 300 and the hook receiving body 200. This locking action results in the axle member 300 being locked in place within the hook receiving body 200 yet still permits the axle member 300 to freely rotate within the hook receiving body 200.

The complete manner of coupling the axle member 300 to the hook receiving body 200 is now described. The axle member 300 is first positioned such that the third section 330 faces the first side wall 210. The axle member 300 is then passed through the opening 240 with the third section 330 being inserted first into the hollow interior space 245. The third section 330 is then directed to and inserted into the recess 250. The third section 330 thus acts as a protrusion that seats within the recess 250. As mentioned, the third section 330 can thus be thought of as a hub that locates and stabilizes the axle member 300 within the hook receiving body 200, while still permitting rotation of the axle member 300.

As the third section 330 travels within the hollow interior space 245 toward the recess 250, the peripheral rim 315 engages the first side wall 210, as described herein, with the peripheral rim 315 flexing to permit insertion of the axle member 300 into the hollow interior space 245. At the time that the peripheral rim 315 clears the first side wall 210, the third section 330 is rotatably contained within the recess 250.

The containment of the third section 330 in the recess 250 secures the inner end portion of the axle member 300 within the hook receiving body 200 and the peripheral rim 315 and the containment of the axle member 300 within the opening 240 secures the outer end portion of the axle member 300 within the hook receiving body 200. The locking of the peripheral rim 315 prevents any unintended dislodgment of the axle member 300 from the hook receiving body 200. The axle member 300 is thus held in a generally perpendicular orientation relative to the side walls 210, 220. In this manner, the axle member 300 is contained and supported within the hook receiving body 200. Preferably, when the axle member 300 is fully inserted and locked in place within the hook receiving body 200, the outer surface (face) of the first section 310 lies at least substantially flush with or slightly recessed with respect to the first side wall 210.

The axle member 300 is thus locked in place (e.g., snap fit) by inserting the axle member 300 into the hollow interior space 245. An audible click or at least a tactile click is felt when the axle member 300 is inserted into and locks with the hook receiving body 200. As shown in the figures, when the axle member 300 is locked in place in the hook receiving body 200, the threaded bore 321 and is axially aligned with and in communication with the hook receiving slot 235 so as to permit the hook to be inserted into and pass through the hook receiving slot 235, thereby allowing the hook to mate to and move with the axle member 300. It will be appreciated that the ends of the hook receiving slot 235 define the ends of travel for the hook. One end of the hook receiving slot 235 is located such that when the hook is positioned at this end, the hook is in a fully extended position in which the hook is generally perpendicular to the cross bar 110. Conversely, when the hook is at the other end of the hook receiving slot 235, the hook is in a fully collapsed position and the hook is oriented generally parallel to the cross bar 110.

Figure 9:
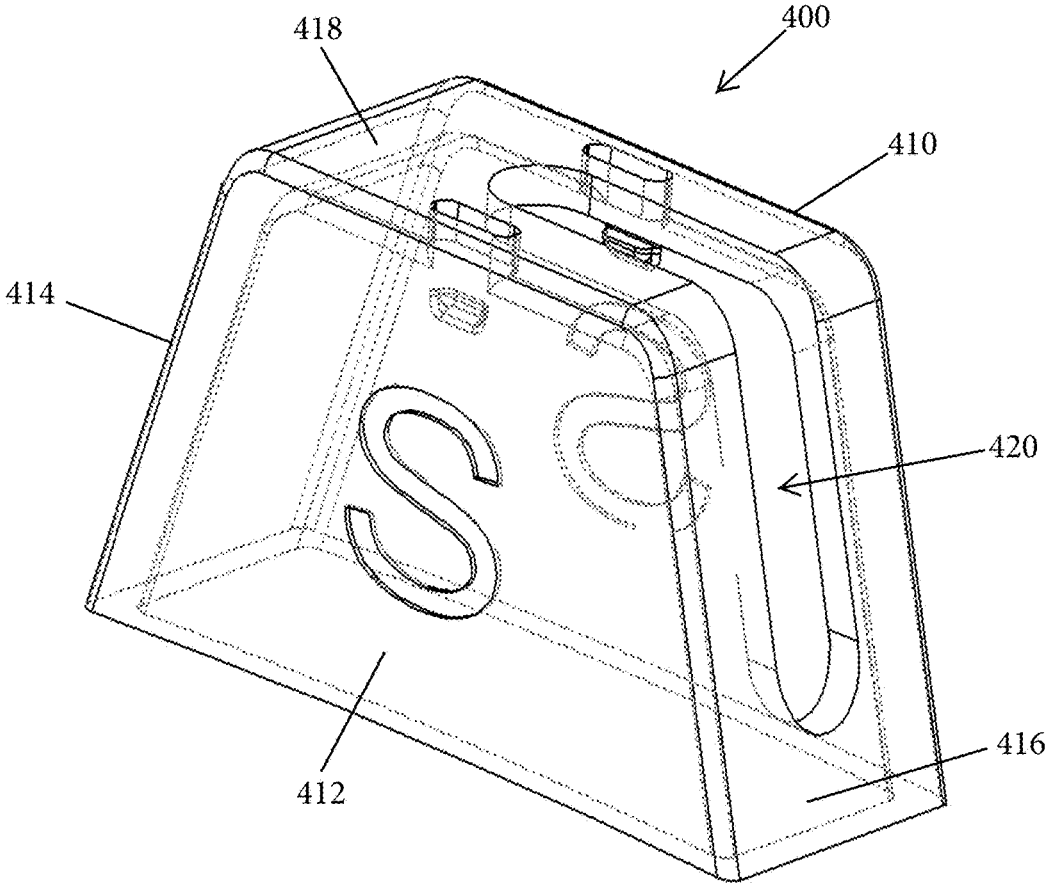
FIG. 9 is a perspective view of a top sizer for reception on the hook receiving body.

FIG. 9 also illustrates that a top sizer 400 can be placed over the hook receiving body 200 and is constructed to accommodate the hook. The top sizer 400 is thus a substantially hollow structure defined by five walls or faces. More particularly, the cross sizer 400 has first and second opposing side walls 410, 412; first and second end walls 414, 416 and a top wall 418. The first and second side walls 410, 412 are completely solid as is the end wall 414; however, the other end wall 416 and the top wall 418 have openings that define a slot 420 which at least substantially mirrors the hook receiving slot 235. In fact, the slot 420 also acts as a hook receiving slot in that the hook passes therethrough and must be able to move therein between the fully extended and fully collapsed positions of the hook.

FIGS. 10A-C illustrate the use of a tool to stabilize the position of the axle member 300 prior to and during the mating of the hook 101 to the opening (recess) 301 of the axle member 300. More specifically, the opening 301 for the hook 101 should be facing upward vertically when the hook 101 is inserted into and mated with the opening 301 to couple the hook 101 to the axle member 300. While the hook 101 is being threadingly mated with the opening 301 of the axle member 300, it is desired to maintain the position of the axle member 300 and prevent rotation of the axle member 300. FIG. 10A shows the use of a tool 500 that has a pair of legs that are received within openings (recesses) 303 formed in the planar outer face of the first section 310 of the axle member 300. The insertion of the tool 500 into openings 303 fixes and maintains the axle member in a desired orientation (i.e., prevents rotation of the axle member 300). FIG. 10B shows the use of a mold component 510 that is similar and has a pair of protrusions (rods) that are received in the openings 303 to maintain the axle member in the desired orientation. FIG. 10C shows the insertion of a hexagonal shaped tool 520 into a hexagonal shaped opening (recess) 305.

FIGS. 11-19C illustrate a garment hanger 600 having a collapsible hook according to another embodiment of the present invention. The garment hanger 600 is similar to garment hanger 100 and includes the central portion 120 that defines a hook receiving area. In particular, the central portion 120 includes a hook receiving body (assembly) 610 that is integral to and extends outwardly from the top edge 111 of the cross bar 110. The hook receiving body 610 includes a first side wall 620 that is integrally formed with the central portion 120 as by being formed during a common molding operation in which the cross bar 110 is formed. The first side wall 620 can have parallel top and bottom edges and inwardly tapered side edges and includes a first (outer) face 622 and an opposing second (inner) face 624. As shown, the first face 622 can be a smooth face; however, it will also be understood that the first face 622 can have a protruding portion as discussed below. The inner face 624 includes a number of features including a recessed portion 630. As shown, the recessed portion 630 can have a circular shape and can be centrally located in the inner face.

The inner face 624 also includes a number of protruding portions disposed about the recessed portion 630. The inner face 624 includes a first side raised portion 640 formed along one side edge of the first side wall 620. The first side raised portion 640 protrudes outwardly from the inner face 624 and an inner side edge thereof has a scalloped shape in that there are a series of adjacent scalloped shaped notches 650 that are formed about the recessed portion 630. The first side raised portion 640 also includes a raised peripheral edge 642 that extends partially along the top edge of the first side wall 620 and along one side edge thereof. The first side raised portion 640 includes at least one bore and in particular, the first side raised portion 640 includes two or more bores (holes) 645, 647. The two bores 645, 647 can have the same shape and/or same dimensions or they can have different shapes and/or different dimensions (e.g., diameters). The bores 645, 647 are formed between the scalloped shaped notches 650 and the side edge.

The inner face 624 also includes a second side raised portion 660 that is located along a second side edge of the first side raised portion 640. The second side raised portion 660 has a bore (hole) 661 formed therein.

An axle drum 670 is configured to be rotatably contained within the recessed portion 630. As shown, the axle drum 670 can have a generally circular shape and includes at least one protrusion 672 that extends radially outward therefrom. The axle drum 670 can also include one or more notches 675 formed therein along a side wall thereof between an inner face 673 and outer face 676 of the axle drum 670. The axle drum 670 also has a hook receiving portion 677 that receives one end of the hook 101 and in particular, a threaded end of the hook 101. The hook receiving portion 677 can thus be in the form of a threaded hole 679 that receives the threads of the hook 101. In the illustrated embodiment, the protrusion 672 is generally opposite the hook receiving portion (threaded hole) 677. The illustrated protrusion 672 is rounded and in particular, can be in the form of a hump, such as being semi-circular in shape. As described herein, the protrusion 672 is configured to seat within one of the scalloped shaped notches 650 as the axle drum 670 is received within the recessed portion 630. The combination of the protrusion 672 with the notches 650 thus presents a gear type arrangement between the two parts.

As can be seen from FIG. 14, the hook 101 has a limited range of rotation and in particular, an inner edge of the first side raised portion 640 acts as a stop and the second side raised portion 660 acts as a different stop. The hook 101 thus can pivot (rotate) between the first and second raised portions 640, 660. As shown in FIG. 14, when the hook 101 is in a fully upright position (i.e., an in use position), the protrusion 672 is received in a bottommost notch 651. As the hook 101 rotates toward a collapsed position (e.g., clockwise rotation from the upright position), the protrusion 672 dislodges from the bottommost notch 651 and moves clockwise and encounters successive notches 650. Each time, the protrusion 672 rotates, a force is needed to cause the protrusion 672 to slide out of its notch 650 and then the protrusion 672 enters into the next notch 650. The materials used to form the axle drum 670 and the first side wall 620 are selected so that the protrusion 672 can move into and out of notches 650 as the hook 101 rotates. When the hook 101 is in the collapsed position, the protrusion 672 is in one of the uppermost notches 650.

It will be appreciated that the first and second raised portions 640, 660 serve to locate and contain the axle drum 670 within the first side wall 620.

The collapsible hook also includes a second side wall 700 (FIG. 15) that in combination with the first side wall 620 forms the hook receiving body 610 (collapsible hook body). The second side wall 700 is configured to mate with the first side wall 620 to form a hook receiving body assembly that contains and securely holds the hook 101 in such a way that the hook 101 can pivot in the manner described herein as shown in FIG. 16.

The second side wall 700 includes a first (outer) face 702 and a second (inner) face 704. In one embodiment, the first face 702 can be a smooth surface or alternatively, the first face 702 can include a local protrusion that extends outwardly therefrom. Similar to the first side wall, the second face 704 of the second side wall 700 includes a recessed portion 710. The recessed portion 710, like the recessed portion 630, can be a circular shaped recess that is centrally located. The recessed portion 710 receives the axle drum 670 such that the axle drum 670 can rotate within the recessed portion 710.

The second side wall 700 preferably has a shape that is complementary to the first side wall 620 and in particular, the illustrated second side wall 700 has parallel top and bottom edges and inwardly tapered side edges. In other words, the second side wall 700 can have a footprint that is at least substantially the same as the first side wall 620 such that when the first and second side walls 620, 700 are coupled to one another, a structure is formed that has clean lines.

The inner face 704 of the second side wall 700 also includes raised portions that are complementary to the raised portions formed along the inner face of the first side wall. The inner face 704 includes a first raised rail 720 that is formed along one of the side edges of the second side wall 700 and at least partially extends along the top edge thereof. The first raised rail 720 thus generally has an L shape. The inner face 704 includes a second raised rail 730 that is located in a bottom corner opposite the side that contains the first raised rail 720. Along the first raised rail 720 are one or more protrusions and in the illustrated embodiment, the first raised rail 720 includes two protrusions 721, 723 that are spaced apart from one another. The two protrusions 721, 723 are sized and shaped so as to be complementary to the two bores 645, 647. As part of the manner for attaching the first side wall 620 to the second side wall 700, the first and second side walls 620, 700 are aligned relative to one another and the protrusions 721, 723 into the two bores 645, 647, respectively. Similarly, the second side wall 730 includes a protrusion 725 that is configured for reception into the bore 661 formed within the second side raised portion 660. FIG. 16 shows reception of the protrusion 725 into the bore 661. The first side wall 620 can include a groove 629 that intersects the bores 645, 647 and another groove 631 intersects the bore 661. The groove 629 receives the first raised rail 720 and the groove 631 receives the second raised rail 730 so as to form an assembled housing structure that contains the axle drum in a rotatable manner.

As shown in the figures, one side of the assembled structure is a closed wall, while the other side and at least a substantial portion of the top of the assembled structure is open so as to define a slot 750 that accommodates the hook 101 which passes therethrough. In the upright position, the hook 101 passes through the top portion of the slot 750 and as the hook 101 pivots to the collapsed position, the hook 101 passes through the side portion of the slot 750 defined along one side of the assembly.

It will be appreciated that any number of different means/techniques can be used to couple the first and second side walls 620, 700 to one another. For example, a mechanical fit can be formed between the two as by a snap-fit fastening arrangement or alternatively, a bonding or weld can be formed between the two after the axle drum is inserted into the recessed portion formed in the first side wall. In the embodiment in which the first side wall 620 is integral to the central portion of the hanger bar, the axle drum 670 is inserted into the recessed portion of the first side wall 620, then the second side wall 700 is positioned and coupled to the first side wall 620 using the techniques mentioned herein or by using other suitable techniques.

FIGS. 17 and 18 illustrate a top sizer 760 for use with the collapsible hook structure described above. The top sizer 760 is a hollow structure defined by first and second side walls 761, 762 and end walls 763, 764 and a top wall 765. The top wall 765 has an enlarged central opening 768 that opens into a side slot 769 to form a slot that accommodates the pivoting movement of the hook 101. The top sizer 760 is thus sized and shaped to be received over the collapsible hook structure such that the top sizer 760 covers the collapsible hook structure.

FIGS. 19A-C show the pivoting of the hook 101 within the first side wall 620. FIG. 19A shows the hook 101 in the upright position; FIG. 19B shows the hook 101 in the beginning phase of collapsing; and FIG. 19C shows the hook 101 in the fully collapsed position. As shown, in FIG. 19A, the hook 101 abuts the stop defined by the inner edge of the first side raised portion 640 and in FIG. 19C, the hook 101 abuts the stop defined by the second side raised portion 660.

FIGS. 20 and 21A and 21B show alternative constructions for the recessed portion for the first side wall and the axle drum. More specifically, the first side wall 620 can include a recessed portion 770 that has a petal like (gear) shape as opposed to the circular shape in the previous embodiment. The recessed portion 770 thus includes a circumferential formation of scalloped shaped notches 771. The scalloped shaped notches 771 are formed along the entire circumference. An axle drum 780 is shaped to be received and securely contained within the recessed portion 770 but as the same time, the axle drum 780 can rotate within the recessed portion 770. Thus, unlike the axle drum 670 that contains a discrete protrusion 672, the axle drum 780 includes a plurality of protrusions 782 that extend about the entire circumference of the axle drum 780. Axle drum 780 has a limited degree of rotation as in the previous embodiment but moves between the upright position and the collapsed position.

FIGS. 21A and 21B illustrate an alternative embodiment in which the outer face the first side wall 620 includes an outward protrusion 790 and is thus not flat and smooth as in the earlier illustrated embodiments. In other words, the recessed portion 630 (FIG. 12) extends through beyond the outer face of the first side wall 620 so as to form a bump out. When an outward protrusion 790 is formed in the first side wall 620 and the recessed portion (e.g., portion 630 or 770), the outward protrusion 790 can and preferably has a small footprint such that a landing 792 is formed between the scalloped shaped notches and the protrusion 790. The axle drum 780 (FIG. 20) seats against the landing 792. FIG. 21B shows the second side wall 700 also including protrusion 701 formed along the outer face thereof. Once again, the protrusion 701 is formed when the recessed portion 710 extends beyond the outer face of the second side wall 700.

The embodiment of FIGS. 11-21 can be implemented with any number of different hanger beam constructions, including but not limited to an I-beam construction as shown.

FIGS. 22-25 illustrates a collapsible hook receiving body 800 that is very similar to the hook receiving body 610 except that instead of being formed, at least partially, as an integral component of the hanger beam, the collapsible hook receiving body 800 can be pre-assembled and then coupled to a hanger beam 810. The hanger beam 810 includes a central portion 820 that is defined by a top edge 822. The top edge 822 is defined by a flat top wall 823 that includes at least one and preferably a plurality of openings (holes). The openings can be of the same type or, as shown, the openings can include two or more different types of openings. For example, the openings can include a first center opening 831 and a pair of side openings 833. The first center opening 831 can serve to locate the assembled hook receiving body 800 along the flat top wall 823. The pair of side openings 833 are formed on either side of the first center opening 831 and can serve as locking openings to actively lock the hook receiving body 800 in place along the flat top wall 823.

The hook receiving body 800 is formed of the second side wall 700 and a first side wall 900 that is very similar to the first side wall 620 and therefore, like elements are numbered alike. The main difference between the first side wall 900 and the first side wall 620 is that the first side wall 900 includes one or more locking fingers 910 that extend outwardly from a bottom of the first side wall 900. As shown in FIG. 22, the first side wall 900 includes a center locking post 920 that is received within the first center opening 831 and a pair of locking fingers 910 that are received within the locking openings 833. The center locking post 920 and the first center opening 831 are complementary and shape and in the illustrated embodiment, both have a circular footprint; however, they can be formed in any number of other shapes.

The locking fingers 910 are configured to produce a locking between the first side wall 900 and the hanger beam 810. In one embodiment, the locking fingers 910 and the openings 833 are configured to form a mechanical attachment between the first side wall 900 and the hanger beam 810. For example, the distal ends of the locking fingers 910 can include locking detents 911 that lock with complementary structures formed as part of the hanger beam 810. The locking fingers 910 are flexible in nature after insertion into the openings 833, the continued force being applied to the first side wall 900 causes flexing of the fingers 910 to cause the locking detents 911 to move into locked positions.

In other words, a snap fit type of attachment can be formed between the first side wall 900 and the hanger beam 810.

It will be understood that the first side wall 900 can be first locked into place relative to the hanger beam 810 and then the axle drum 670 is inserted therein prior to attaching the second side wall 700 to the first side wall 900. The second side wall 700 and the first side wall 900 are attached to one another in the manner described hereinbefore. Alternatively, the axle drum 670 can be inserted into the first side wall 900 and then the second side wall 700 is attached to the first side wall 900 to form an assembly. The assembly is then attached to the hanger beam in its assembled form. It will be appreciated that the alternative constructions shown in FIGS. 20-21 can be implemented with the embodiment shown in FIGS. 22-25.

Now turning to FIGS. 26-29, a garment hanger 1000 is illustrated and is similar to the previously described garment hangers in that like the others, garment hanger 1000 includes a collapsible hook feature. The exemplary garment hanger 1000 includes a crossbar 1010 that defines a first end 1012 and an opposing second end 1014. A central portion 1005 of the cross bar 1010 includes a hook receiving body 1100, that can be identical or similar to hook receiving body 200, that is integral to and extends outwardly from a top edge 1011 of the cross bar 1010.

The hook receiving body 1100 like hook receiving body 200 is designed to contain the working components of the collapsible hook. For example, the hook receiving body 200 can be the same as the hook receiving body shown in FIGS. 11-16, including the drum 670 that is coupled to the hook 101.

Garment hanger 1000 includes a feature that allows the folding of and accommodation of the hook 101 especially when the garment hanger 1000 is a pants hanger and thus, the cross bar 1010 does not includes the central portion 120 (FIG. 11) but instead, the cross bar 1010 is more of a linear structure that extends from first end 1012 to second end 1014. As is the case with pants type hangers, each of the first end 1012 and the second end 1014 includes a clamp 1015 configured to grip the garment, e.g., pants. The cross bar 1010 does not include a central portion like the central portion 120 associated with the other hanger types, and therefore the hook receiving body 1100 is not as elevated relative to the end portions of the cross bar 1010. As a result, when the hook 101 is pivoted to a lowered position (transportation position), the hook 101 can strike the cross bar 1010 and not be to be positioned in a fully lowered position in which a bottom portion of the hook 101 that is attached to the rotatable drum is at least substantially parallel to the longitudinal axis of the cross bar 1010 or an axis passing through the bottom portion of the hook 101 intersects the cross bar 1010. In other words, the top curved part of the hook 101 would strike the cross bar 1010 without the teachings of the present invention and thus be prevented from being fully pivoted to the fully lowered position. This is an undesirable situation since the hook 101 cannot be placed in the desired fully retracted position that allows for optimal packing of multiple hangers.

In accordance with the present invention, the cross bar 1010 is constructed to accommodate the hook 101 and more specifically, the cross bar 1010 is formed so as to permit the hook 101 to pivot toward and pass through the cross bar 1010 without any obstruction. The illustrated cross bar 1010 is generally C-shaped and defined by a top wall 1020, an intermediate wall 1030 and a bottom wall 1040. The top wall 1020 is formed so as to be perpendicular to the intermediate wall 1030 and similarly, the bottom wall 1040 is formed so as to be perpendicular to the intermediate wall 1030 resulting in a C-shaped structure. The top wall 1020 and bottom wall 1040 can thus be thought of as being lips or flanges. The top wall 1020 and bottom wall 1040 extend from the first end 1012 to the second end 1014.

To accommodate movement (pivoting) of the hook 101, one end of the cross bar 1010 is modified and in particular, a portion of the cross bar 1010 proximate the second end 1014 is modified compared to the portion of the cross bar 1010 proximate the first end 1012. As shown in the figures, it will be appreciated that the hook 101 pivot towards the second end 1014. The cross bar 1010 thus has a hook receiving portion 1200. The hook receiving portion 1200 is in the form of a first cutout (cutaway) or notch 1210 that is formed in the top wall 1020 within the hook receiving portion 1200 and optionally, and preferably, a second cutout (cutaway) or notch 1220 that is formed in the bottom wall 1040 within the hook receiving portion 1200. The first cutout 1210 and second cutout 1220 are in registration with one another in that the first cutout 1210 is located above the second cutout 1220. Together, the first cutout 1210 and the second cutout 1220 define a passageway for the hook 101 as it is pivoted to its fully retracted position. The first cutout 1210 and the second cutout 1220 can be formed as either a partial cutaway of the top wall 1020 (i.e., there is a portion of the top wall between the notch and a surface of the intermediate wall) and the bottom wall 1040, respectively, or can be a complete localized removal of the top wall 1020 and the bottom wall 1040, respectively. In any event, the amount of the top wall 1020 and bottom wall 1040 that is removed in both a width direction (a direction toward the intermediate wall 1030) and a length direction (a longitudinal direction of the cross bar) is selected so that the hook 101 can safely pass through the first and second cutouts 1210, 1220 without any interference between the hook 101 and the body of the cross bar 1010.

FIGS. 26 and 27 show the hook 101 in its retracted (lowered position) in which the hook 101 is at least partially contained within the first cutout 1210 and the second cutout 1220. FIGS. 28A, 28B and 29 show the hook 101 in a partially lowered position prior to the hook 101 being inserted into the first cutout 1210 and the second cutout 1220.

The above-described feature thus permits the hook 101 to be moved to a fully retracted (lowered) position which is the desired storage and transportation position. In the fully lowered hook position, the hangers 1000 can be stored and arranged in an optimally compact arrangement, thereby reducing packing and transportation costs.

The ends of the notches 1210, 1220 can be curved (sloped edges) as shown.

While the hanger 1000 has been described as a pants hanger, it will be understood that the feature shown in FIGS. 26-29 can be implemented in other types of hangers that have similar cross bar constructions. In other words, the feature of the present invention can be implemented in any cross bar that would otherwise interfere with the rotatable hook 101 as it pivots to a lowered position. In addition, instead of being a C-shaped cross bar, the cross bar can be in the form of an I-shape or other shapes.

It will be clear that the first and second notches 1210, 1220 can be formed in the cross-bars of any of the hangers described herein and with any of the axle members described herein.

FIGS. 30-33 illustrate another aspect of the invention. More specifically, the hook receiving body and rotatable drum can include raised protrusions, such as ridges, that are formed according to a predetermined pattern and located to mate (interact) with one another to assist in positioning and locking the rotatable drum in a given position.

It will be appreciated that the features illustrated in FIGS. 30-33 can be implemented in any of the hook receiving bodies and any of the rotatable drums illustrated herein. For purpose of illustration, FIGS. 30-33 show these features implemented in the hook receiving body 610 shown in FIG. 11. For ease of illustration, the same reference characters are used in FIGS. 30-33 to represent the same parts as in FIGS. 11-16. As discussed in FIGS. 11-16, the hook receiving body 610 is formed of the first side wall 620 and the second side wall 700. In the embodiment of FIGS. 30-33, each of the recessed portion 630 of the first side wall 620 and the recessed portion 710 of the second side wall 700 includes a raised surface feature and more particularly, the inner facing surface of the recessed portion 630 and the inner facing surface of the recessed portion 710 includes a raised profile (raised protrusion(s)). More specifically, the recessed portion 630 can include a first raised profile 1300 that protrudes outwardly from the inner surface of the recessed portion 630. In the illustrated embodiment, the first raised profile 1300 is in the form of a series of spokes that are arranged about a common center of the circular shaped recessed portion 630. The spokes are thus circumferentially spaced apart from one another. The spokes can be formed equidistant apart such that the angle between any two adjacent spokes is the same. As also shown, the spokes do not interest at the center of the circular shaped recessed portion 630 but instead terminate proximate thereto so as to form a small circular shaped inner portion 1302 that is free of any raised structure. In contrast, the radially outer end of each spoke can intersect the side wall that defines the periphery of the circular shaped recessed portion.

Similarly, the recessed portion 710 can include a second raised profile 1310 that protrudes outwardly from the inner surface of the recessed portion 710. In the illustrated embodiment, the second raised profile 1310 is in the form of a series of spokes that are arranged about a common center of the circular shaped recessed portion 710. The spokes are thus circumferentially spaced apart from one another. The spokes can be formed equidistant apart such that the angle between any two adjacent spokes is the same. As also shown, the spokes do not interest at the center of the circular shaped recessed portion 710 but instead terminate proximate thereto so as to form a small circular shaped inner portion 1312 that is free of any raised structure. In contrast, the radially outer end of each spoke can intersect the side wall that defines the periphery of the circular shaped recessed portion.

It will be appreciated that in an alternative embodiment, only one of the recessed portion 630 and recessed portion 710 includes the raised profile.

As shown in FIG. 33, the rotatable axle drum 670 is also formed to have a raised profile that is complementary to at least one of and preferably both of the first raised profile 1300 and the second raised profile 1310. In particular, a first outer surface of the axle drum 670 that is inserted into the recessed portion 630 of the first side wall 620 can include a third raised profile 1320 and similarly, an opposite second outer surface of the axle drum 670 that is inserted into the recessed portion 710 of the second side wall 700 can include the third raised profile 1320. It will therefore be appreciated that the third raised profile 1320 is complementary to each of the first raised profile 1300 and the second raised profile 1310 such that the two are in selective contact and engagement with one another. Thus, in the illustrated embodiment, the third raised profile 1320 is in the form of a series of spokes that are arranged about a common center of the circular shaped end of the axle drum 670. The spokes are thus circumferentially spaced apart from one another. The spokes can be formed equidistant apart such that the angle between any two adjacent spokes is the same. As also shown, the spokes do not intersect at the center of the circular shaped end of the axle drum but instead terminate proximate thereto so as to form a small circular shaped inner portion 1322 that is free of any raised structure. In contrast, the radially outer end of each spoke can extend to the outer edge of the circular shaped end surface of the drum 670.

The ridges that define the various raised profiles thus contact one another and serve to lock the axle drum 670 in a desired orientation. In other words, as the axle drum 670 is rotated, the raised profile 1320 (ridges/spokes) at the two end surfaces of the axle drum 670 contacts and engages the first raised profile 1300 and the second raised profile 1310, respectively. As one ridge (spoke) contacts another, the user will feel the interference and the ridges of the third raised profile 1320 can be captured between adjacent ridges of the respective first raised profile 1300 or second raised profile 1310. This capture prevents unintended rotation of the axle drum 670 and thereby serves to hold the axle drum in place.

Tactile and auditory feedback can be provided as a result of the engagement between the complementary raised profiles and can be heard as a clicking noise as the ridges on the drum 670 move between the ridges 1300, 1310 formed in the complementary recessed portions 630, 710.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A collapsible hook hanger comprising:

a hook having a lower end and a curved upper end;

a hanger body including a cross bar having a top wall;

a hook receiving body extending from the top wall of the cross bar, the hook receiving body having a hook receiving slot for receiving the hook; and an axle member disposed within the hook receiving body and having a hole that is in communication with the hook receiving slot for receiving and mating to the lower end of the hook;

wherein the hook is rotatable between a first upright position and a second folded position;

wherein the top wall of the cross bar includes a notch that receives the curved upper end of the hook as it is rotated to the second folded position and in the second folded position, the curved upper end is disposed along one side of the hanger body.

2. The collapsible hook hanger of claim 1, wherein the cross bar has a C-shape and is defined by the top wall, a bottom wall spaced from the top wall, and an intermediate wall that extends between the top wall and the bottom wall, the top wall and the bottom wall protruding outwardly from the intermediate wall.

3. The collapsible hook hanger of claim 2, wherein the notch passes through both the top wall and the bottom wall.

4. The collapsible hook hanger of claim 3, wherein the notch in each of the top wall and the bottom wall is sized to permit at least the curved upper end of the hook to be received within the notch of each of the top wall and the bottom wall.

5. The collapsible hook hanger of claim 4, wherein in the second folded position, the curved upper end of the hook lies below the bottom wall of the cross bar.

6. The collapsible hook hanger of claim 3, wherein the notch in the top wall is a mirror image of the notch in the bottom wall.

7. The collapsible hook hanger of claim 2, wherein the top wall includes an inner portion that is located between the notch and a surface of the intermediate wall.

8. The collapsible hook hanger of claim 2, wherein the hanger comprises a pants hanger that includes clamps at ends of the cross bar, each clamp being disposed forward of the front edges of the top wall and the bottom wall.

9. The collapsible hook hanger of claim 1, wherein the hook receiving body is defined by a first side wall and an opposing second side wall, wherein an inner surface of the second side wall includes a first recess that is located opposite a second recess formed in the first side wall, and wherein the axle member having a first portion that is rotatably disposed within the first recess of the first side wall and a second portion that is rotatably received within the second recess in the second side wall; wherein the axle member includes a locking feature that interlocks with the first side wall resulting in the axle member being rotatably captured within the hook receiving body.

10. The collapsible hook hanger of claim 9, wherein the first portion comprises a first face of the axle member and the second portion comprises a second face of the axle member and the locking feature comprises a protrusion that extends radially outward from a side wall of the axle member and is received within one of a plurality of shaped notches that surround the first recess.

11. The collapsible hook hanger of claim 10, wherein the axle member comprises an arcuate shaped protrusion and the plurality of notches comprises a plurality of scalloped shaped notches formed within a first raised portion that surrounds the first recess.

12. The collapsible hook hanger of claim 9, wherein the first side wall comprises a first part and the second side wall comprises a second part, the first and second parts being configured to couple to one another with the axle member captured therebetween within the first and second recesses.

13. The collapsible hook hanger of claim 12, wherein the first side wall is integrally formed with the cross bar and the second side wall is attached to the first side wall by the snap-fit.

14. The collapsible hook hanger of claim 12, wherein an inner face of the second side wall includes a plurality of protrusions that are received within complementary bores formed in an inner face of the second side wall to couple the first and second side walls to one another.

15. The collapsible hook hanger of claim 9, wherein the axle member has a gear shape defined by a plurality of spaced protrusions and the first side wall includes a raised wall within a plurality of scalloped shaped notches that surround the first recess.

16. The collapsible hook hanger of claim 9, wherein the first recessed portion includes a first raised profile, the second recessed portion includes a second raised profile, and an outer surface of each of the first portion and the second portion of the axle member includes a third raised profile that engages the first raised profile and the second raised profile for locking the axle member in a selected orientation within the first recessed portion and the second recessed portion.

17. The collapsible hook hanger of claim 16, wherein each of the first raised profile, the second raised profile and the third raised profile comprises a plurality of raised spokes that are arranged in a circumferential pattern.

18. The collapsible hook hanger of claim 17, wherein inner sections of the plurality of raised spokes do not intersect but instead a circular shaped area free of the plurality of raised spokes is formed.

19. The collapsible hook hanger of claim 1, wherein the hook receiving slot is formed within one end wall of the hook receiving body and is open along a top of the hook receiving body.

20. A collapsible hook hanger comprising:

a hook having a lower end;

a hanger body including a cross bar having a top wall;

a hook receiving body extending from the top wall of the cross bar, the hook receiving body having a hook receiving slot for receiving the hook; and an axle member disposed within the hook receiving body and having a hole that is in communication with the hook receiving slot for receiving and mating to the lower end of the hook;

wherein the hook is rotatable between a first upright position and a second folded position;

wherein the top wall of the cross bar includes a notch that receives the hook as it is rotated to the second folded position;

wherein the notch is formed closer to an end of the cross bar than to the hook receiving body.

21. A collapsible hook hanger comprising:

a hook having a lower end;

a hanger body including a cross bar having a C-shape cross section defined by a top wall, a bottom wall spaced from the top wall, and an intermediate wall disposed between the top wall and the bottom wall, the top wall and bottom wall being formed perpendicular to the intermediate wall and being parallel to one another;

a hook receiving body extending from the top wall of the cross bar, the hook receiving body having a hook receiving slot for receiving the hook; and an axle member disposed within the hook receiving body and having a hole that is in communication with the hook receiving slot for receiving and mating to the lower end of the hook;

wherein the hook is rotatable between a first upright position and a second folded position;

wherein the top wall of the cross bar includes a first notch for receiving the hook as it is rotated to the second folded position and the bottom wall includes a second notch that is disposed below the first notch for receiving the hook as it is rotated to the second folded position, wherein in the second folded position, a curved free end of the hook is disposed below the bottom wall and passes through the first notch and the second notch.

* * * * *